US007610007B2

(12) United States Patent
Kojima et al.

(10) Patent No.: US 7,610,007 B2
(45) Date of Patent: Oct. 27, 2009

(54) CLEANING BLADE, AND CLEANING APPARATUS, PROCESS CARTRIDGE, AND IMAGE FORMING APPARATUS USING THE SAME

(75) Inventors: Noriaki Kojima, Ebina (JP); Koichi Tanaka, Minamiashigara (JP); Satoshi Shigezaki, Ebina (JP); Hiroe Okuyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 420 days.

(21) Appl. No.: 11/366,752

(22) Filed: Mar. 3, 2006

(65) Prior Publication Data

US 2006/0216084 A1 Sep. 28, 2006

Related U.S. Application Data

(63) Continuation-in-part of application No. 11/177,407, filed on Jul. 11, 2005, now abandoned.

(30) Foreign Application Priority Data

Mar. 4, 2005 (JP) ..... 2005-060647
Feb. 27, 2006 (JP) ..... 2006-051219

(51) Int. Cl.
*G03G 21/00* (2006.01)

(52) U.S. Cl. ..... 399/350

(58) Field of Classification Search ..... 399/350, 399/351, 345, 273, 274
See application file for complete search history.

(56) References Cited

U.S. PATENT DOCUMENTS 5,576,130 A * 11/1996 Yu et al.
5,987,297 A * 11/1999 Kimoto et al. ..... 399/350
6,703,472 B2 * 3/2004 Miura et al. ..... 399/350
6,835,512 B2 12/2004 Morikawa et al.
2001/0006755 A1 * 7/2001 Itami et al. ..... 399/350
2002/0076633 A1 * 6/2002 Niimi

FOREIGN PATENT DOCUMENTS

| | | |
|---|---|---|
| JP | 53-32599 | 8/1978 |
| JP | A 62-262074 | 11/1987 |
| JP | A 64-90479 | 4/1989 |
| JP | A 3-120577 | 5/1991 |
| JP | A 8-176293 | 7/1996 |
| JP | A 8-208820 | 8/1996 |
| JP | A 10-143039 | 5/1998 |
| JP | A 2001-343874 | 12/2001 |
| JP | A 2003-241599 | 8/2003 |
| JP | A-2004-220020 | 8/2004 |
| JP | A-2004-361844 | 12/2004 |

* cited by examiner

*Primary Examiner*—David M Gray
*Assistant Examiner*—Laura K Roth
(74) *Attorney, Agent, or Firm*—Oliff & Berridge, PLC

(57) ABSTRACT

The present invention provides a cleaning blade for cleaning a surface of an object to be cleaned, comprising:

a contact portion that contacts the surface of the object for cleaning, the contact portion being made of a material satisfying the following inequalities (1) to (3):

$$3.92 \leqq M \leqq 29.42 \quad (1);$$

$$0 < \alpha \leqq 0.294; \text{ and} \quad (2)$$

$$S \geqq 250 \quad (3)$$

wherein M denotes 100% modulus (MPa); α denotes the ratio {Δstress/Δstrain degree=(stress at 200% strain degree−stress at 100% strain degree)/(200−100)} (MPa/%) of the stress alteration (Δstress) to the strain alteration (Δstrain) in a range of 100% to 200% strain degree in the stress-strain curve; and S denotes the breaking elongation (%), and a cleaning apparatus, a process cartridge, and an image forming apparatus comprising the cleaning blade.

26 Claims, 5 Drawing Sheets

CLEANING BLADE, AND CLEANING APPARATUS, PROCESS CARTRIDGE, AND IMAGE FORMING APPARATUS USING THE SAME

CROSS-REFERENCE TO RELATED APPLICATION

This application is a continuation-in-part of application Ser. No. 11/177,407, filed on Jul. 11, 2005. This application claims priority under 35 USC 119 from Japanese Patent Application Nos. 2005-060647 and 2006-051219, the disclosures of which are incorporated by reference herein.

BACKGROUND OF THE INVENTION

1. Field of the Invention

The present invention relates to a cleaning blade to be used in a copying machine for forming images by electrophotography, and to a cleaning apparatus, a process cartridge, and an image forming apparatus using the same.

2. Description of the Related Art

Generally, formation of an image by electrophotography or an electrostatic recording method is carried out by forming an electrostatic latent image on an image holding member such as a photoreceptor, forming a toner image by developing the electrostatic latent image with a developer, and successively transferring and fixing the toner image on a recording medium. An image forming apparatus employing the above-mentioned image forming method is generally provided with a cleaning apparatus for cleaning the toner remaining on the image holding member after the transfer of the toner image.

Various types of cleaning apparatuses are known and, typically, a blade cleaning method in which a cleaning blade (a contact plate having elasticity is generally used) is installed so as to have a contact with the image holding member and thus scrape off any toner remaining on the image holding member has been employed in many cases.

In the case of low-to-middle speed apparatuses, contact type charging apparatuses such as charging rolls have widely been used as the charging members of an image holding member. The reasons for the wide use of a contact type charging apparatus are that as compared with a non-contact type charging apparatus using Corotron charging, the contact type apparatus is accompanied with very little ozone generation and is therefore environment-friendly, and that the contact type apparatus is compact and economical in cost since it requires no ozone filter or air blow.

On the other hand, a contact type charging apparatus has the problem that the deposition amount of electrically discharged residue to a photoreceptor is considerably larger than that of a non-contact type charging apparatus using corotron charging. This is because the electric discharge region is very close to the photoreceptor, although the absolute amount of the electrically discharged residue is less than that generated in the case of a non-contact type charging apparatus. Therefore, in the case of using a contact type charging apparatus and a cleaning blade in combination, there occur problems of wearing, cracking, and curling of the cleaning blade and torque increase of the photoreceptor operation system owing to the increase of the friction coefficient.

To prevent these problems, apparatuses capable of removing the electrically discharged residue discharged onto the surface of an image holding member and lowering the friction force on a cleaning blade have been proposed For example, methods for removing the electrically discharged residue by sliding a magnetic brush and a sponge roll containing an abrasive agent on the surface of an image holding member have been proposed (see, for example, Japanese Patent Application Laid-Open (JP-A) Nos. 10-143039 and 1-090479). Further, there have been other methods proposed which provide improved wear resistance of a cleaning blade by selecting proper materials such as, for example, a method of using a material having low friction and high hardness for a portion of a cleaning blade which is brought into contact with an image holding member (see, for example, JP-A 2001-343874) and a method of using a material having high modulus (high hardness) for a portion of a cleaning blade which is brought into contact with an image holding member (see, for example, JP-A 2003-241599).

In the case where a two-component development method using a developer containing a magnetic carrier and a toner is employed, the toner development is carried out by applying predetermined development bias to a development roll and thereby applying a development electric field between the development roll and an image holding member for transferring the toner to an electrostatic latent image and in such a process, there occurs the BCO (Bead Carry Over) phenomenon in which a portion of the magnetic carrier is transferred to the surface of the image holding member owing to the electrostatic attraction force.

On the other hand, unlike normal carrier of a substantially spherical shape, fine powder carrier pulverized carrier) generated in a developer production process or a development apparatus often has a sharp debris shape. Accordingly, if BCO takes place, at the time of transferring a toner image to an toner-receiving body, the fine powder carrier is easily buried in the surface of the image holding member owing to the transfer electric field or the transferring pressure between the image holding member and the toner-receiving body and the fine powder carrier is firmly fixed in the surface of the image holding member once adhered to the surface.

Along with a rotation of the image holding member, the carrier thus adhered to the surface of the image holding member is repeatedly brought into contact with a cleaning blade being brought into contact with the surface of the image holding member, such that edge-cracking takes place in the cleaning blade. To prevent such a phenomenon, apparatuses for trapping the carrier adhered to the surface of the image holding member have been proposed. For example, an apparatus for trapping the carrier by forming an electric field between a trapping member and a photoreceptor (see, JP-A No. 62-262074) and apparatuses for trapping the carrier by magnetic attraction force (see, JP-A No. 3-120577 and Japanese Utility Model Application Publication (JP-Y) No. 53-32599) have been proposed.

However, neither addition of means for removing the electrically discharged residue in order to improve the wear resistance of the cleaning blade nor addition of carrier trapping means for trapping the fine powder carrier which adheres to the surface of the image holding member along with occurrence of BCO and becomes a cause of edge-cracking, to an image forming apparatus is desirable in terms of miniaturization and cost cutting. Further, carrier with a sharp debris shape being transferred to and buried in the surface of the image holding member at the time of transferring a toner image needs to be prevented. In this case, between the development step and the transfer step, carrier with a sharp debris shape adhered to the surface of the image holding member has to be removed without disturbing the loner image developed on the image holding member.

Therefore, to trap the carrier with a small particle diameter and a sharp debris shape adhered to the surface of the image holding member, a magnetic field or electric field more intense than that in the case of trapping a carrier with a normal particle diameter is required To generate a more intense magnetic field or electric field, it is necessary to set the trapping means closer to the photoreceptor. However, the trapped carrier scratches the toner image on the image holding member during transportation if the trapping means is simply set closer to the photoreceptor and thus it is very difficult to completely remove the carrier shifted to the image holding member without disturbing of the toner image.

On the other hand, if a material with high hardness or high modulus is employed as the material for a portion of the cleaning blade to be brought into contact with the image holding member to improve the wear resistance of the cleaning blade, in general, the resistance is improved but the elasticity is decreased. If the elasticity is decreased, rubber-like properties are lost and it becomes difficult for the cleaning blade to expand. Owing to difficulty of expansion, when foreign substances such as carrier debris buried in the surface of the image holding member along with the occurrence of BCO pass the contact part between the edge of the cleaning blade and the surface of the image holding member, the edge tip end cannot be deformed in response the force of the foreign substances deforming the edge and is easily cracked.

Accordingly, to prevent the edge-cracking of the cleaning blade, it is advantageous that a material having a somewhat low hardness so that the edge tip end deforms (expands) when foreign substances pass the contact part between the edge of the cleaning blade and the surface of the image holding member is used to form the edge tip end part. However, a material with low hardness is inferior in wear resistance, so that it cannot maintain good cleaning capability for a long period of time.

SUMMARY OF THE INVENTION

The present invention has been made in view of the above circumstances and provides a cleaning blade, and cleaning apparatus, a process cartridge, and an image forming apparatus using the same.

A first aspect of the present invention is to provide a cleaning blade for cleaning a surface of an object to be cleaned, comprising:

a contact portion that contacts the surface of the object for cleaning, the contact portion being made of a material satisfying the following inequalities (1) to (3):

$$3.92 \leqq M \leqq 29.42; \quad (1)$$

$$0 < \alpha \leqq 0.294; \text{ and} \quad (2)$$

$$S \geqq 250 \quad (3)$$

wherein M denotes 100% modulus (MPa); α denotes the ratio {(Δstress/Δstrain degree=(stress at 200% strain degree−stress at 100% strain degree)/(200−100)}(MPa/%) of the stress alteration (Δstress) to the strain alteration (Δstrain) in a range of 100% to 200% strain degree in the stress-strain curve; and S denotes the breaking elongation (%).

A second aspect of the invention is to provide a cleaning apparatus comprising the cleaning blade described in the first aspect.

A third aspect of the invention is to provide a process cartridge detachably attached to an image forming apparatus, the process cartridge comprising:

an image holding member, and the cleaning apparatus described in the second aspect.

A fourth aspect of the invention is to provide an image forming apparatus comprising:

at least one object to be cleaned; and at least one cleaning apparatus having the cleaning blade described in the first aspect

BRIEF DESCRIPTION OF THE DRAWINGS

Preferred embodiments of the invention will be described in detail on the following figures, wherein.

Figure 1:
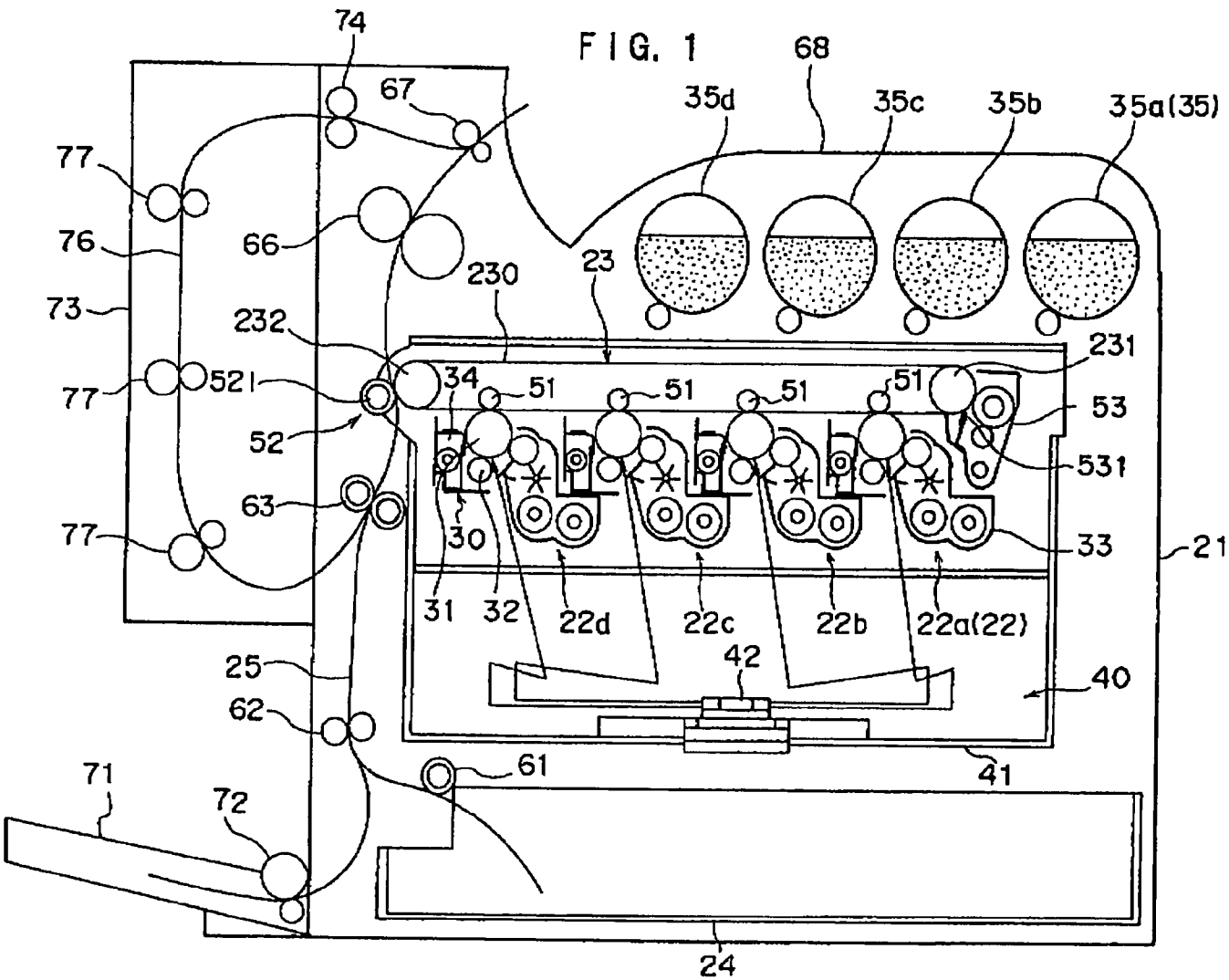
FIG. 1 is a schematic illustration showing one example of an image forming apparatus of the invention.

DETAILED DESCRIPTION OF THE INVENTION (Cleaning Blade)

A cleaning blade for cleaning the surface of an object member to be cleaned by being brought into contact with the surface of the object member to be cleaned, wherein a material of at least a portion of the cleaning blade to be brought into contact with the object member to be cleaned satisfies the characteristics of the following inequalities (1) to (3):

$$3.92 \leqq M \leqq 29.42; \quad \text{Inequality (1)}$$

$$0 < \alpha \leqq 0.294; \text{ and} \quad \text{Inequality (2)}$$

$$S \geqq 250, \quad \text{Inequality (3)}$$

(wherein M denotes 100% modulus (MPa); α denotes the ratio {Δstress/Δstrain degree=(stress at 200% strain degree−stress at 100% strain degree)/(200−100)}(MPa/%) of the stress alteration (Δstress) to the strain alteration (Δstrain) in a range of 100% to 200% strain degree in the stress-strain curve; and S denotes the breaking elongation (%) measured according to JIS K6251 (using a dumbbell-type No. 3 test piece), the disclosure of which is incorporated by reference herein.

With respect to the cleaning blade of the invention, since the material for a portion to be brought into contact with the surface of the object member to be cleaned (hereinafter the portion is referred to as an edge part or an edge tip end or the material composing the portion is referred to as an edge part material or an edge tip end material in some cases) satisfies the inequality (1), the cleaning blade is excellent in wear resistance while exhibiting good cleaning capability.

If the 100% modulus M is less than 3.92 MPa (40 kgf/cm$^2$), the wear resistance becomes insufficient and the cleaning capability cannot be kept good for a long period of time. On the other hand, if it exceeds 29.42 MPa (300 kgf/cm$^2$), the edge material is so hard that it deteriorates the capability of following to the object member to be cleaned and thus no good cleaning capability is provided. Additionally, the surface of the object member to be cleaned may sometimes be scratched.

The 100% modulus M is preferably in a range of 5 to 20 MPa and more preferably in a range of 6.5 to 15 MPa.

Since the edge material satisfies the inequality (2) and the inequality (3), the cleaning blade is excellent in the cracking resistance. In the case where $\alpha$ in the inequality (2) exceeds 0.294, the edge material is insufficient in the softness. Therefore, along with occurrence of BCO, just like foreign substances buried and fixed in the surface of an image holding member, when foreign substances existing in the surface of the object member to be cleaned, specially foreign substances buried and fixed in the surface, repeatedly pass the contact part of the object member to be cleaned and the cleaning blade and high stress is thus repeatedly applied to the edge tip end of the cleaning blade, the edge tip end cannot be so deformed as to efficiently diffuse the stress and accordingly the edge is cracked within a relatively short period. Consequently, because of the cracking in an early stage, it is impossible to maintain a good cleaning capability for a long period of time.

The value of a is preferably 0.2 or lower and more preferably 0.1 or lower and it is better as the value a is closer to 0, which is the ultimate lower limit of the physical property.

Further, if the breaking elongation S defined by the inequality (3) is lower than 250%, when the foreign substances in the surface of the object member to be cleaned as described above and the edge tip end come into collision with a high force against each other, the edge tip end is drawn and cannot following the deformation and for that, the edge cracking occurs within a relatively short time. Consequently, because of the cracking in an early stage, it is impossible to maintain a good leaning capability for a long period of time.

The breaking elongation S is preferably 300% or higher and more preferably 350% or higher, and from the edge cracking point of view, the higher the breaking elongation S, the more preferable. However, when the breaking elongation S is 500% or higher, conformability (adhesiveness) with respect to the object member to be cleaned is increased, and accordingly, the friction force applied to the object member to be cleaned is increased. As a result, edge wear may easily occur. Therefore, from the edge wear point of view, the breaking elongation S is preferably 500% or less, more preferably 450% or less, and most preferably 400% or less.

The ambient or environmental temperature of the cleaning blade in the image forming apparatus is in a range of about 10 to 60° C. Therefore, when the grass transition temperature Tg of the material of a portion, at which the cleaning blade is brought into contact with the of the object member to be cleaned, exceeds the environmental temperature, friction characteristics of the cleaning blade arc lost, whereby a pressure under which the cleaning blade is brought into contact with the surface of the object member to be cleaned may be unstable. Accordingly, it is preferable that the glass transition temperature Tg of the material for forming the portion which is brought into contact with the surface of the object member to be cleaned has a lower limit of value (10° C.) or less.

On the other hand, if the glass transition temperature Tg of the material is 10° C. or lower, as the glass transition temperature is lowered, the impact resilience R of the material of the portion of the cleaning blade, which is brought into contact with the object member to be cleaned, becomes smaller. Particularly when the impact resilience R is less than 10%, sticking and slipping behaviors at the edge tip end of the cleaning blade are deteriorated, whereby more portions which are slid and rubbed in a deformed state may be formed at a certain position at which the cleaning blade which is brought into contact with the object member to be cleaned.

If such a position at which the edge tip end of the blade and the object member to be cleaned are kept in contact with each other is not cancelled by the sticking and slipping behaviors, friction occurs with the position unchanged, whereby local edge deformation occurs easily. If local plastic deformation occurs on the cleaning blade, adhesiveness between the edge tip end of the blade and the object member to be cleaned is deteriorated, and cleaning failure thereby occurs. In order to prevent such local plastic deformation, it is preferable that the sticking and slipping behaviors of the edge tip end of the cleaning blade are performed all the time. To this end, under the environmental temperature of 10° C. or higher which is a substantial lower limit of the environmental temperature when the cleaning blade is used, the impact resilience R is preferably 10% or higher, more preferably 15% or higher, and most preferably 20% or higher.

The impact resilience is measured on the basis of JIS K6255, the disclosure of which is incorporated by reference herein.

The 100% modulus M defined by the inequality (1) is calculated from the stress at the time of 100% strain by measurement at 500 mm/min pulling speed using a dumbbell-type No. 3 test piece according to JIS K6251. Strograph AE elastomer manufactured by Toyo Seiki Co., Ltd. is used as the measuring apparatus.

The value $\alpha$ redefined by the inequality (2) is calculated from the stress-strain curve and the stress and the strain degree are calculated by the following procedure and method. That is, the measurement is carried out at 500 mm/min pulling speed using a dumbbell-type No. 3 test piece according to JIS K6251 to measure the stress at the time of 100% strain and the stress at the time of 200% strain. Strograph AE elastomer manufactured by Toyo Seiki Co., Ltd. is used as the measuring apparatus.

Further, the value S defined by the inequality (3) is calculated according to JIS K6251 (using a dumbbell-type No. 3 test piece).

Further, in the present invention, a glass transition temperature of a material of a portion of the cleaning blade to be brought into contact with the surface of the object member to be cleaned, and that of a soft segment material or a hard segment material which will be described later arc determined as a peak temperature of tan $\delta$ (loss tangent) by measuring temperature distribution by using a visco-elastic measuring apparatus.

Here, tan $\delta$ can be determined by a storage modulus of elasticity and loss modulus of elasticity which will be described below.

When sinusoidal wave distortion is charged on a linear elastic body in a steady-state vibration, the stress is expressed by the following equation (4), wherein $|E^*|$ is referred to as a "complex modulus of elasticity".

In a rheological theory, an elastic body component is expressed by the following equation (5) and a viscous body component is expressed by the following equation (6), wherein E' is referred to as a "storage modulus of elasticity" and E" is referred to as a "loss modulus of elasticity". $\delta$ represents a phase difference angle formed between the stress and the distortion, and referred to as a "kinetic loss angle".

The value of tan $\delta$ is expressed by E"/E' in the following equation (7), and is referred to as "loss sine". The higher the value of tan $\delta$, the more rubber elasticity the linear elastic body will have.

$$\sigma=|E^*|\gamma\cos(\omega t) \quad \text{Equation (4)}$$

$$E'=|E^*|\cos\delta \quad \text{Equation (5)}$$

$$E'=|E^*|\sin\delta \quad \text{Equation (6)}$$

$$\tan\delta=E''/E' \quad \text{Equation (7)}$$

The value of tan δ is measured at a static distortion of 5%, upon a receipt of a sine tension excitation at a frequency of 10 Hz, and at the temperatures of 60 to 100° C. with Rheopectolar-DVE-V4 manufactured by Rheology Co., Ltd. as a measuring apparatus.

As described, the cleaning blade of the invention is excellent in both wear resistance and cracking resistance and maintaining good cleaning capability for a long period of time.

Accordingly, unlike a conventional case, it is not necessary to install a new apparatus for improving the wear resistance and cracking resistance additionally in an image forming apparatus so as to solve a problem of foreign substances existing in the surface of the object member to be cleaned, specially foreign substances buried and fixed in the surface, just like foreign substances buried and fixed in the surface of an image holding member along with occurrence of BCO, and therefore enlargement and cost up of the apparatus can be avoided.

Additionally, since the life of the cleaning blade is prolonged, a process cartridge, a cleaning apparatus, and an image forming apparatus comprising the cleaning blade of the invention can be provided with long lives and their maintenance cost is made easy to be low. Specially, if a process cartridge or an image forming apparatus comprises both of an image holding member with improved wear resistance of the surface and the cleaning blade of the invention, the cartridge or the apparatus is more advantageous in the above-mentioned properties.

With respect to the cleaning blade of the invention, at least the edge material is a material satisfying the inequalities (1) to (3) and not only the edge part but also other part may be made of the material satisfying the inequalities (1) to (3).

The material satisfying the inequalities (1) to (3) is not particularly limited, however it is particularly preferable to be an elastomer material containing hard segments and soft segments. Containing both hard segments and soft segments, the elastomer material can easily satisfy the physical properties defined by the inequalities (1) to (3) and can provide both of high wear resistance and high cracking resistance.

Additionally, "hard segments" and "soft segments" mean that the material composing the former is a material relatively harder than the material composing the latter and the material composing the latter is a material relatively softer than the material composing the former.

The elastomer material containing hard segments and soft segments is preferable to have a glass transition temperature in a range of −50 to 30° C. and more preferably in a range of −30 to 10° C. If the glass transition temperature exceeds 30° C., the cleaning blade may possibly become fragile in a temperature range for practical use of the cleaning blade. If the glass transition temperature is lower than −50° C., the cleaning blade may sometimes not be provided with sufficient hardness and stress in a range for practical use.

Consequently, to realize the above-mentioned glass transition temperature, the glass transition temperature of a material composing the hard segments in the elastomer material (hereinafter, sometimes referred to as a hard segment material) is preferably in a range of 35 to 100° C. and more preferably in a range of 35 to 60° C. and the glass transition temperature of a material composing the soft segments in the elastomer material (hereinafter, sometimes referred to as a soft segment material) is preferably in a range of −100 to −50° C. and more preferably in a range of −90 to −60° C.

Further, in the case of using the hard segment material and the soft segment material having the above-mentioned glass transition temperatures, the weight ratio of the hard segment material to the total weight of the hard segment material and the soft segment material (hereinafter, sometimes referred to as hard segment material ratio) is ably in a range of 46 to 96% by weight, more preferably 50 to 90% by weight, and even more preferably 60 to 85% by weight.

If the hard segment material ratio is less than 46% by weight, the wear resistance of the edge tip end becomes so insufficient as to cause wear in an early stage and accordingly the good cleaning property cannot be maintained for a long period of time in some cases. If the hard segment Material ratio exceeds 96% by weight, the edge tip end becomes too bard to maintain sufficient softness and drawability and cracking occurs in an early stage and accordingly, the good cleaning property cannot be maintained for a long period of time in some cases.

The combination of the hard segment material and the soft segment material is not particularly limited and materials may be selected from conventionally known resin materials such that one is relatively harder than the other or one is relatively softer than the other and in this invention, the following combinations are preferable.

That is, as the hard segment material, a polyurethane resin is preferable to be used. In this case, the weight average molecular weight of the polyurethane is preferably in a range of 1,000 to 4,000 and more preferably in a range of 1,500 to 3,500.

In the case where the weight average molecular weight is lower than 1,000, if the cleaning blade is used in a low temperature environment, the elasticity of the polyurethane resin composing the hard segments is lost, and cleaning failure sometimes tends to occur easily. If the weight average molecular weight exceeds 4,000, the permanent strain of the polyurethane resin composing the hard segments becomes significant and the edge tip end cannot maintain the contact force to the object member to be cleaned to result in cleaning failure in some cases.

As the polyurethane resin to be used as the above-mentioned hard segment material, Placcel 205 and Placcel 240 manufactured by Daicel Chemical Industries, Ltd. can be exemplified.

Also, as the soft segment material in the case of using the polyurethane resin as the hard segment trial (1) it is preferable to use a resin having a functional group reactive to isocyanate group. Further, the resin is preferable to have physical properties: (2) a glass transition temperature of 0° C. or lower; (3) a viscosity of 600 to 35,000 mPa·s at 25° C.; and (4) a weight average molecular weight in a range of 700 to 3,000. If these physical properties are not satisfied, the formability at the time of producing the cleaning blade sometimes is insufficient or the properties of the cleaning blade sometimes are insufficient.

The physical properties are more preferable to be as follows: the glass tradition temperature is −10° C. or lower, the viscosity at 25° C. is in a range of 1,000 to 3,000 mPa·s; and the weight average molecular weight is in a range of 900 to 2,800. In the case where the cleaning blade is produced by centrifugal molding, the viscosity is preferable in a range of 600 to 3,500 mPa·s at 25° C.

As the soft segment material satisfying the above-mentioned structure and physical properties (1) to (4) may be selected properly from conventionally known resins and a soft resin having functional group reactive to isocyanate in at least the terminal is preferable. Further, the resin is preferably an aliphatic resin having a straight chain structure in terms of the softness. As practical examples, acrylic resins having two or more hydroxyl groups, polybutadiene resins having two or more hydroxyl groups or epoxy resins having two or more epoxy groups are preferable to be used.

As the acrylic resins having two or more hydroxyl groups, Actflow (grade: UMB-2005B, UMB-2005P, UMB-2005, UME-2005, and the like) manufactured by Soken Chemical Engineering Co., Ltd. can be exemplified and as the polybutadiene resin having two or more hydroxyl groups, R-45HT and the like manufactured by Idemitsu Kosan Co., Ltd. can be exemplified.

As the epoxy resin having two or more epoxy groups, unlike conventional epoxy resins having hard and fragile properties, those which are softer and tougher than conventional epoxy resins are preferable.

As such epoxy resins, those having a structure (a soft skeleton) with high flexibility of the main chain in the main chain structure are preferable in terms of molecular structure, and as the flexible structure, an alkylene skeleton, a cycloalkane skeleton, and a polyoxyalkylene skeleton can be exemplified and especially the polyoxyalkylene skeleton is preferable.

In terms of the physical properties, as compared with conventional epoxy resins, epoxy resins with a low viscosity in relation to the molecular weight are preferable. More concretely, the weight average molecular weight is preferably in a range of about 900±100 and the viscosity at 25° C. is preferably in a range of 15,000±5,000 mPa·s and more preferably in a range of 15,000±3,000 mPa·s. As an epoxy resin having such properties, EPLICON EXA-4850-150 and the like manufactured by Dainippon Ink and Chemicals, Inc. can be exemplified.

The cleaning blade of the invention is not particularly limited if, as described above, at least the edge part is made of a material satisfying the inequalities (1) to (3) and the entire body of the cleaning blade may be made of such a material. In the case where the cleaning blade has a layered structure composed of two or more layers, the layer to be brought into contact with the surface of the object member to be cleaned is preferable to be made of the material satisfying the inequalities (1) to (3).

As the production method of the cleaning blade of the invention, conventionally known methods can be employed depending on the raw materials to be used for producing the cleaning blade and for example, the cleaning blade can be produced by forming a sheet by centrifugal molding or extrusion molding and cutting or machining the sheet into a predetermined shape or sticking two or more sheets.

In the case of cleaning an object member to be cleaned using the cleaning blade of the invention, as the object member to be cleaned, an object for cleaning, is not particularly limited in an image forming apparatus and for example, an intermediate transfer body, a charging roll, a transfer roll, a transportation belt for a transfer material, a paper feeding roll, and also a detoning roll for removing a toner from a cleaning brush for removing a toner from an image holding member can be exemplified and specially, the image holding member is particularly preferable.

Use of the cleaning blade of the invention suppresses occurrence of cracking attributed to foreign substances such as carriers buried and fixed in the surface of the image holding member owing to occurrence of BCO and at the same time, a toner, an externally added agent, electrically discharged residue, talc and paper powder adhered to the surfaces of a variety of object members to be cleaned as described above can stably be cleaned out for a long period of time.

(Cleaning Apparatus, Process Cartridge, and Image Forming Apparatus)

Next, a cleaning apparatus, a process cartridge and an image forming apparatus using the cleaning blade of the invention will be described.

The cleaning apparatus of the invention is not particularly limited if the apparatus comprises the cleaning blade of the invention as a cleaning blade to be brought into contact with the surface of an object member to be cleaned for cleaning the surface of the object member. For example, as a configuration example of the cleaning apparatus, those which comprise a cleaning blade fixed in a cleaning case having an opening part against the object member to be cleaned side in a manner that the edge tip end is in the opening part side and a transportation auger for leading the foreign substances such as a used toner collected from the surface of the object member to be cleaned by the cleaning blade to a foreign substance recovery container can be exemplified. The cleaning apparatus of the invention may comprise two or more cleaning blades.

When the cleaning blade of the present invention is used for cleaning an image holding member, in order to prevent an image flow during the image formation, a force "NF Normal Force)" when the cleaning blade is pressed to be brought into contact with the image holding member is preferably in a range of 2.0 to 6.0 gf/mm, and more preferably in a mange of 4.0 to 5.0 gf/mm. The length "d" of the edge tip end of the cleaning blade bitten into the image holding member is preferably in a range of 0.4 to 1.6 mm and more preferably in a range of 0.8 to 1.4 mm. The angle "W/A (working angle)" formed by the cleaning blade and the image holding member being brought into contact with each other is preferably 6.0 to 14.0°, and more preferably 8.0 to 12.0°. Young's modulus "E" in the axial direction of the cleaning blade per 1 mm is preferably in a range of 60 to 130 gf/mm$^2$, and more preferably in a range of 90 to 110 gf/mm$^2$.

During cleaning, when abrasives or lubricants are provided between the cleaning blade and the image holding member, since the cleaning blade of the present invention can exhibit excellent extension characteristics in conformity with a rotation of the image holding member as long as the values of NF, a biting length, an angle W/A, and a young's modulus E are limited to the aforementioned ranges, the amount of abrasives or lubricants to be held at a closely contacted portion at which the cleaning blade and the image holding member are closely contacted to each other can be increased.

Therefore, the increase of the amount of the abrasives to be held at the closely contacted portion can result in the improvement in the scrape-off performance of the electrically discharged residue which causes image flowing. Further, the increase of the amount of the lubricants to be held at the closely contacted portion can result not only in the improvement in the scrape-off performance of the electrically discharged residue but also in the reduction of wearing between the edge tip end of the blade and the photoreceptor.

Further, as supplying sources of the abrasives or the lubricants, those provided at the exterior of the toner or solidified abrasives which are made to contact with media such as brushes being brought into contact with the image holding member can be used.

Moreover, with respect to the rotating direction of the image holding member, a toner-holding body is preferably provided so as to be brought into contact with the image holding member at a rotation direction upstream side of the image holding member than the side at which the cleaning blade is provided, of the image holding member, and also at the downstream side of the transfer station of the toner image.

In this case, since the electrically discharged residue adhered onto the surface of the image holding member can be removed by the toner-holding body and the toner deposited on the toner-holding body, image flowing due to the electrically discharged residue can be prevented noticeably. Besides, since frictions between the cleaning blade and the image holding member can be minimized, occurrences of wearing onto the cleaning blade can be suppressed for a long period of time.

The toner-holding body is preferably vibrated in parallel or at right angle with respect to the rotation direction of the image holding member. Due to the vibration of the toner-holding body, the discharged residue can be removed more effectively, and occurrences of image flowing can be prevented eve better.

Further, with respect to the rotation direction of the image holding member, a toner reservoir is preferably provided at a rotational direction downstream side of the image holding member than the side at which the toner-holding body is provided, of the image holding member, and in a region at the rotational direction upstream side in which the cleaning blade is provided. Accordingly, since the toner in the toner reservoir can absorb the electrically discharged residue, image flowing can be suppressed even better.

For example, unwoven fabrics or brushes can be used as materials for forming a portion of the toner-holding body to be kept in contact with the image holding member. Fabrics made by other fibers can be used as well. In the case of unwoven fabrics, sponge is stuck to the bottom of unwoven fabric, secured to the shaft of an SUS or a metal, and uses However, unwoven fabrics can be used in a roll state.

As a power for vibrating the toner-holding body, an exterior power source such as a motor or the like can be used, or a driving force can be applied from the image holding member or other image forming apparatuses to the toner-holding body through gears or the like. Further, vibration period is preferably in a range of 0.1 to 5 seconds so as not to separate the toner from the toner-holding body.

When the cleaning blade is fixed to the cleaning apparatus main body through a metal plate spring so as to face in an upper direction than a direction in which gravity is applied, the toner reservoir can be formed by uniformly sticking a tape made of a resin such as polyester or the like, to the metal plate in parallel to the shaft direction of the cleaning blade. Here, the tip end of the tape is attached to the metal plate so as to protrude from the tip end of the cleaning blade.

Accordingly, the toner removed by the cleaning blade is accumulated in the region partitioned by the tape, and when a predetermined amount of the toner or greater is accumulated into the partitioned region, the toner is brought into contact with the image holding member.

Thus, the toner accumulated into the toner reservoir is partially brought into contact with the image holding member to absorb the electrically discharged residue on the surface of the image holding member. As a result, image flowing due to the electrically discharged residue can be suppressed.

Further, by changing a material, a length, or a thickness of the tape, the amount of the toner kept in the toner reservoir can be controlled. Alternatively, by forming holes on the tape to circulate a toner in the toner reservoir, the toner can escape through the holes. Further, by forming a toner reservoir by forming the toner entering therein anytime, the scrape-off performance of the electrically discharged residue can be improved. Further, if the scrape-off performance of the electrically discharged residue using the toner reservoir is positively relied on, by reducing the pressure with respect to the image holding member, a predetermined amount of the electrically discharged residue can be removed by the toner-holding body and the toner reservoir.

On the other hand, charging of the image holding member is carried out by using a discharge by a charging unit such as a charging roll. The amount required for charging the surface of the image holding member to a predetermined potential is changed in accordance with thickness of the image holding member, and temperature/moisture around the image forming apparatus.

Generally, since the thinner the thickness of the image holding member, the smaller the discharging amount for obtaining specified charging potentials becomes, occurrences of the electrically discharged residue can be minimized by controlling the discharging amount in accordance with the thickness. Further, since the higher the temperature, and the higher the moisture, the smaller the discharging amount for obtaining specified charged potentials becomes. Accordingly, the amount of the electrically discharged residue can be minimized by controlling the discharging amount in accordance with temperature or moisture.

Therefore, thickness of the image holding member or temperature/moisture are detected by using some means. On the basis of the detection results, the minimum discharging amount can be determined, whereby occurrences of the electrically discharged residue which may cause image flowing can be suppressed effectively. This can prevent image flowing from becoming serious even if it occurs. Accordingly, if the cleaning blade according to the present invention is used under such a condition, image flowing can be prevented to a great deal.

On the other hand, the process cartridge of the invention is not particularly limited if it comprises an image holding member and the cleaning apparatus of the invention for cleaning the surface of the image holding member and is made detachable from an image forming apparatus The image forming apparatus of the invention is not particularly limited if it comprises at least one cleaning apparatus of the invention for cleaning at least one of object members to be cleaned such as an image holding member, an intermediate transfer body and the like installed in the image forming apparatus. For example, in the case of so-called tandem apparatus having image holding members corresponding to respective color toners, the cleaning apparatus of the invention may be installed for each image holding member. In addition, other than the cleaning apparatus of the invention, a cleaning brush or the like may be used in combination, based on the necessity.

—Image Holding Member (Photoreceptor)—

As an image holding member to be used for a process cartridge and an image forming apparatus, conventionally known photoreceptors such as an organic photoreceptor and inorganic photoreceptors such as an amorphous silicon photoreceptor and a selenium type photoreceptor can be used and organic photoreceptors, excellent and advantageous in the cost, the productivity, and disposal property, are used preferably.

An organic photoreceptor is not particularly limited if it comprises at least a photosensitive layer on a conductive substrate and in this invention, an organic photoreceptor comprising a function separation type photosensitive layer composed of a charge generation layer and charge transport layer, on a conductive substrate in this order is preferable to efficiently exhibit the cleaning capability. Further, based on the necessity, a surface protection layer may be formed on the surface of the photosensitive layer and an intermediate layer may be formed between the photosensitive layer and the conductive substrate or between the photosensitive layer and the surface protection layer.

Examples of the conductive substrate may include a metal drum of such as aluminum, copper, iron, a stainless steel, zinc, and nickel; those obtained by depositing a metals such as aluminum, copper, gold, silver, platinum, palladium titanium, nickel-chromium, a stainless steel, copper-indium on a substrate such as a sheet, paper, plastic, glass and the like; those obtained by depositing conductive metal compounds such as indium oxide, tin oxide and the like on the above-mentioned substrate; those obtained by laminating a metal foil on the above-mentioned substrates; and those obtained by dispersing carbon black, indium oxide, tin oxide-antimony oxide powder, a metal powder and copper iodide in binder resins and applying the mixtures to the above-mentioned substrates. The shape of the conductive subsume may be drum-like, sheet-like, or plate-like shape.

Further, in the case where a pipe substrate made of metal is used as a conductive substrate, the surface of the pipe substrate made of metal may be as it is or the substrate surface may previously be subjected to surface roughening treatment. Such surface roughening can prevent wood grain pattern-like concentration unevenness possible to be caused in the photoreceptor inside owing to interference light rays in the case where interferential light source such as laser beam is used as an exposure light source. As a method for the surface treatment, specular cutting, etching, anodization, rough cutting, center-less grinding, sand blast, wet horning and the like can be exemplified.

Specially, in terms of the adhesion improvement to the photosensitive layer and film formability, an aluminum substrate whose surface is anodized is preferable to be used as a conductive substrate.

The charge generation layer is formed by depositing a charge generation material by a vacuum evaporation method or applying a solution containing a charge generation material, an organic solvent and a binder resin.

As the charge generation material, inorganic photoconductors such as amorphous selenium, crystalline selenium, selenium-tellurium alloy, selenium-arsenic alloy, other selenium compounds, selenium alloy, zinc oxide, and titanium oxide; those obtained by dye-sensitizing them, various kinds of phthalocyanine compounds such as metal-free phthalocyanine, titanyl phthalocyanine, copper phthalocyanine, tin phthalocyanine, and gallium phthalocyanine; various kinds of organic pigments such as squarilium, anthoanthrone, perylene, azo, anthraquinone, pyrene, pyrylium, thiapyrylium salts; or dyes may be used.

These organic pigments generally have several types of crystal sires and specially in the case of phthalocyanine compounds, various crystal types such as α-type and β-type have been known and if they are pigments providing sensitivity and other properties corresponding to aims, any crystal structure can be employed.

Among the above-mentioned charge generation material, a phthalocyanine compound is preferable. In this case, when light is radiated to the photosensitive layer, the phthalocyanine compound contained in the photosensitive layer absorbs photon and generates a carrier. At that time, since the phthalocyanine compound has a high quantum efficiency, the compound can efficiently absorb the absorbed photon and generate the carrier.

As the binder resin to be used for the charge generation layer, the following examples can be exemplified. That is, bisphenol A type or bisphenol Z type polycarbonate resin and its copolymers, polyarylate resins, polyester resins, methacrylic resins, acrylic resins, poly(vinyl chloride) resins, polystyrene resins, poly(vinyl acetate) resins, styrene-butadiene copolymer resins, vinylidene chloride-acrylonitrile copolymer resins, vinyl chloride-vinyl acetate-maleic anhydride resins, silicone resins, silicon-alkyd resins, phenol-formaldehyde resins, styrene-alkyd resins, and poly(N-vinylcarbazole).

These binder resins may be used alone or two or more of them may be mixed for the use. The mixing ratio of the charge generation material and the binder resin (charge generation material: binder resin) is preferably in a range of 10:1 to 1:10 by weight. The thickness of the charge generation layer is, in general preferably in a range of 0.01 to 5 μm and more preferably in a range of 0.05 to 2.0 μm.

The charge generation layer may contain at least one kind of electron acceptor substances aiming to lessen the residual potential and the fatigue in the case of repeated use. As the electron acceptor substance, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorene, picric acid, o-nitrobenzoic acid, p-nitrobenzoic acid, and phthalic acid can be used for the charge generation layer. Among them, fluorenone type, quinone type, or benzene derivatives having electron attractive substituent groups such as Cl, CN, $NO_2$ and the like are especially preferable.

A method for dispersing the charge generation material in a resin may be methods using a roll mill, a ball mill, a vibration ball mill, an attriter, a Dyno-mill, a sand mill, a colloid mill and the like.

As a solvent of a coating solution for forming the charge generation layer, conventionally known organic solvents, for example, aromatic hydrocarbon type solvents such as toluene, chlorobenzene, and the like; aliphatic alcohol type solvents such as methanol, ethanol, n-propanol, iso-propanol, and n-butanol; ketone type solvents such as acetone, cyclohexanone, and 2-butanone; halogenated aliphatic hydrocarbon solvents such as methylene chloride, chloroform, and ethylene chloride; cyclic or straight chain ether type solvents such as tetrahydrofuran dioxane, ethylene glycol, diethyl ether, and ester type solvents such as methyl acetate, ethyl acetate, and n-butyl acetate.

As the charge transport layer, those which are formed by conventionally known methods can be used The charge transport layer may be formed by using a charge transport material and a binder resin or using a polymer charge transport material.

Examples of the charge transport material may include electron transporting compounds for example, quinone type compounds such as p-benzoquinone, chloranil, bromanil, and anthraquinone; tetracyanoquinodimethane type compounds; fluorenone compounds such as 2,4,7-trinitroflurenone; xanthone type compounds, benzophenone type compounds, cyanovinyl type compounds, and ethylene type compounds; and electron hole transporting compounds such as trialkylamine type compounds, benzidine compounds, arylalkane type compounds, aryl-substituted ethylene type compounds; stilbene type compounds, anthracene type compounds, and hydazone type compounds.

These charge transport materials may be used alone or two or more of them may be used in form of a mixture, however the materials are not limited to the above-mentioned examples. These charge transport materials may be used alone or two or more of them may be used inform of a mixture, and in terms of the mobility, materials defined by the structural formulas (1) to (3) are preferable to be used.

Structural formula (1)

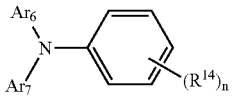

In the structural formula (1), $R^{14}$ denotes hydrogen or methyl; n denotes 1 or 2; $Ar_6$ and $Ar_7$ independently denote an (un)substituted aryl or —C($R^{18}$)═C($R^{19}$)($R^{20}$), —CH═CH—CH═C$(Ar)_2$ and the substituent group may be a halogen atom, an alkyl group having 1 to 5 carbon atoms, an alkoxy group having 1 to 5 carbon atoms, or an amino group having a substituent group of an alkyl having 1 to 3 carbon atoms.

Sturctural formula (2)

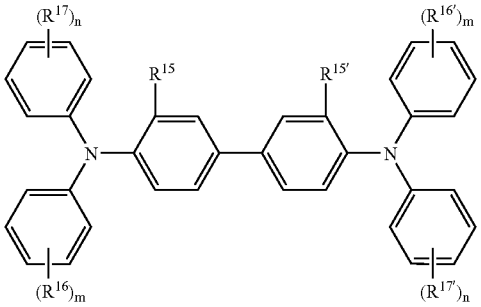

In the structural formula (2), $R^{15}$ and $R^{15'}$ may be same or different and independently denote hydrogen, a halogen atom, an alkyl group having 1 to 5 carbon atoms, or an alkoxy group having 1 to 5 carbon atoms; $R^{16}$, $R^{16'}$, $R^{17}$, and $R^{17'}$ may be same or different and independently denote hydrogen, a halogen atom, an alkyl group having 1 to 5 carbon atoms, or an alkoxy group having 1 to 5 carbon atoms, an amino group having a substituent group of an alkyl having 1 to 2 carbon atoms, an (un)substituted aryl or —C($R^{18}$)═C($R^{19}$)($R^{20}$), —CH═CH—CH═C$(Ar)_2$.

In the structural formulas (1) and (2), $R^{18}$, $R^{19}$, and $R^{20}$ independently denote hydrogen, an (un)substituted alkyl, or an (un)substituted aryl; and m and n independently denote an integer of 0 to 2.

In the structural formula (3), $R^{21}$ denotes a hydrogen atom, an alkyl having 1 to 5 carbon atoms, or an alkoxy having 1 to 5 carbon atoms, an (un)substituted aryl, or —CH═CH—CH═C$(Ar)_2$; $R^{22}$ and $R^{23}$ may be same or different and independently denote a hydrogen atom, a halogen atom, an alkyl group having 1 to 5 carbon atoms, or an alkoxy group having 1 to 5 carbon atoms, an amino group having a substituent group of an alkyl group having 1 to 2 carbon atoms, or an (un)substituted aryl.

With respect to the substituent group in the structural formulas (1) to (3), Ar denotes an (un)substituted aryl group.

Examples to be used as the binder resin to be used for the charge transport layer may be polycarbonate resins, polyester resins, methacrylic resins, acrylic resins, poly (vinyl chloride) resins, poly(vinylidene chloride) resins, polystyrene resins, poly(vinyl acetate) resins, styrene-butadiene copolymers, vinylidene chloride-acrylonitrile copolymers, vinyl chloride-vinyl acetate copolymers, vinyl chloride-vinyl acetate-maleic anhydride copolymer, silicon resins, silicon-alkyd resins, phenol-formaldehyde resins, styrene-alkyd resins; polymer charge transport materials such as poly (N-vinylcarbazole), polysilane, and polyester type polymer charge transport materials described in JP-A Nos. 8-176293 and 8-208820. These binder resins may be used alone or two or more of them can be used in form of a mixture. The mixing ratio of the charge transport material and the binder resin is preferably 10:1 to 1:5 by weight.

The polymer charge transport material may be used alone. As the polymer charge transport material, conventionally known materials having charge transporting property such as poly (N-vinylcarbazole) and polysilane can be employed Specially, polyester type polymer charge transport materials shown in JP-A Nos. 8-176293 and 8-208820 have high charge transporting property and therefore particularly preferable. The polymer charge transport materials may be used as they are for the charge transport layer and may be used in combination with the above-mentioned binder resins to form the charge transport layer.

The thickness of the charge transport layer is, in general, preferably 5 to 50 μm and more preferably 10 to 30 μm. As a coating method, conventional methods such as a blade coating method, a Mayor bar coating method, a spray coating method, a dip coating method, a bead coating method, an air knife coating method, and a curtain coating method can be employed Further, as the solvent to be used for forming the charge transport layer, aromatic hydrocarbons such as ben- Structural formula (3)

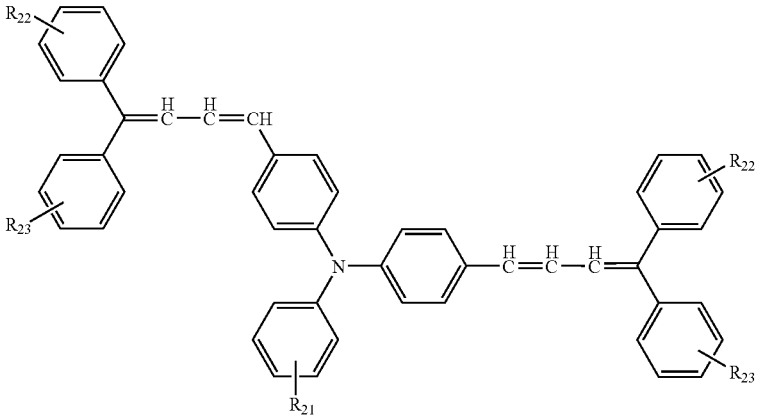

zene, toluene, xylene, and chlorobenzene; ketones such as acetone and 2-butanone; halogenated aliphatic alcohol type solvents such as methylene chloride, chloroform, and ethylene chloride; cyclic or straight chain ether type solvents such as tetrahydrofuran and ethyl ether may be used alone or two or more of them may be used in combination.

In order to prevent deterioration of the photoreceptor by ozone or an acidic gas generated in a copying machine or light or heat, additives such as an antioxidant, a photostabilizer, a heat stabilizer or the like may be added in the photosensitive layer. For example, as an antioxidant, hindered phenol, hindered amine, p-phenylenediamine, arylalkane, hydroquinone, spirochroman, spiroindanone, and their derivatives, organic sulfur compounds, and organic phosphorus compounds can be exemplified Examples of the photostabilizer may be benzophenone, benzotriazole, dithiocarbamate, tetramethylpiperidine, and their derivatives.

In order to improve the sensitivity, lower the residual potential and suppress the fatigue at the time of repeated use, at least one electron acceptor substance may be added. Examples usable as the electron acceptor substance in the invention may be succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, pieric acid, o-nitrobenzoic acid, p-nitrobenzoic acid, phthalic acid, and compounds defined by formula (1). Among them, fluorenone type, quinone type, or benzene derivatives of having electron attractive substituent groups such as Cl, CN, $NO_2$ and the like are especially preferable.

The outermost surface of the image holding member is preferable to be a layer containing fluoro resin particles such as polytetrafluoroethylene (PTFE) and a layer containing a resin having a crosslinked structure.

In the case where the photosensitive layer of the image holding member is a function separation type photosensitive layer composed of a charge generation layer and charge transport layer on a conductive substrate in this order, the charge transport layer may contain fluoro resin particles. Or, a suffice protection layer formed on the charge transport layer may contain a resin having a crosslinked structure.

In the case where a charge transport layer containing the fluoro resin particles is formed on the surface of the image holding member, the friction force between the cleaning blade and the surface of the image holding member is lowered, so that scratches and wear of the surface of the image holding member can be suppressed and abrasion and cracking of the edge tip end of the cleaning blade can be suppressed to prolong the life of the image holding member itself and at the same time void formation between the image holding member and the cleaning blade can be suppressed to prolong the cleaning capability.

The content of the fluoro resin particles in the charge transport layer in the case where the particles are added to the layer is preferably 0.1 to 40% by weight, more preferably 1 to 30% by weight, and even more preferably 3 to 10% by weight in the total amount of the materials composing the charge transport layer. If the content is less than 0.1% by weight, the friction decreasing effect of dispersion of the fluoro resin particles sometimes becomes insufficient in the case where a charger of the image holding member is a contact type charger. On the other hand, if it exceeds 40% by weight, the luminous transmittance and the carrier transporting property of the charge transport layer are considerably decreased and the residual potential is sometimes increased owing to repeated use.

As the fluoro resin particles to be used in the invention, one or more of resins and polymers properly selected from tetrafluoroethylene resins, trifluorochloroethylene resins, hexafluoropropylene resins, fluorovinyl resins, fluorovinylidene resins, difluorodichloroethylene resins, and their copolymers are preferable and especially tetrafluoroethylene resins and fluorovinylidene resins are preferable.

The primary average particle diameter of the fluoro resin particles is preferably 0.05 to 1 μm, and more preferably 0.1 to 0.5 μm If the primary average particle diameter is smaller than 0.05 μm, agglomeration tends to be promoted at the time of dispersion and if it exceeds 1 μm, image quality defects tend to be caused.

In the case where the surface protection layer containing the resin having the crosslinked structure is formed on the surface of the image holding member, as the resin having a crosslinked structure phenol type resins, urethane type resins, and siloxane type resins can be exemplified. Since these resins having the crosslinked structure have excellent wear resistance, wear or scratch formation on the surface of the image holding member can be suppressed even after long time use.

Further, the resin having a crosslinked structure is preferably a resin having a charge transport material As the resin having a crosslinked structure, various materials can be used, and in respect of characteristics, use of a phenol resin, an urethane resin, a siloxane resin and the like is preferable, and a siloxane-based resin is particularly preferable. Especially, a resin having a structure derived from a compound represented by the formula (I) or (II) is excellent in strength and stability and is thus particularly preferable.

$$F\text{-}[D\text{-}Si(R^2)_{(3-a)}Q_a]_b \quad (I)$$

In the formula (I), F is an organic group derived from a compound having hole transportability, D is a flexible subunit, $R^2$ represents hydrogen, an alkyl group or a substituted or unsubstituted aryl group, Q represents a hydrolyzable group, a is an integer of 1 to 3, and b is an integer of 1 to 4.

The flexible subunit represented by D in the formula (I) shall always contain —$(CH_2)_n$— group, which may be combined with —COO—, —O—, —CH═CH— or —CH═N— group to form a divalent linear group. In the —$(CH_2)_n$— group, n is an integer of 1 to 5. The hydrolyzable group represented by Q represents —OR group wherein R represents an alkyl group.

$$F\text{—}((X)_nR_1\text{-}ZH)_m \quad (II)$$

In the formula (II), F is an organic group derived from a compound having hole transportability, $R_1$ is an alkylene group, Z is —O—, —S—, —NH— or —COO— and m is an integer of 1 to 4. X represents —O— or —S—, and n is integer of 0 or 1.

The compound represented by the formula (I) or (II) is more preferably a compound wherein the organic group F is represented particularly by the following formula (III):

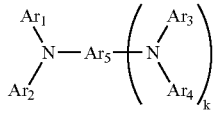

(III)

In the formula (III), $Ar_1$ to $Ar_4$ independently represent a substituted or unsubstituted aryl group, $Ar_5$ represents a substituted or unsubstituted aryl or arylene group and simultaneously two to four of $Ar_1$ to $Ar_5$ have a linking bond represented by -D-$Si(R^2)_{(3-a)}Q_a$ in the formula (I). D is a flexible subunit, $R^2$ represents hydrogen, an alkyl group or a substituted or unsubstituted aryl group, Q represents a hydrolyzable group, and a is an integer of 1 to 3.

In the formula (III), $Ar_1$ to $Ar_4$ independently represent a substituted or unsubstituted aryl group, and are specifically preferably groups represented by the following structure group 1:

Structure Group 1

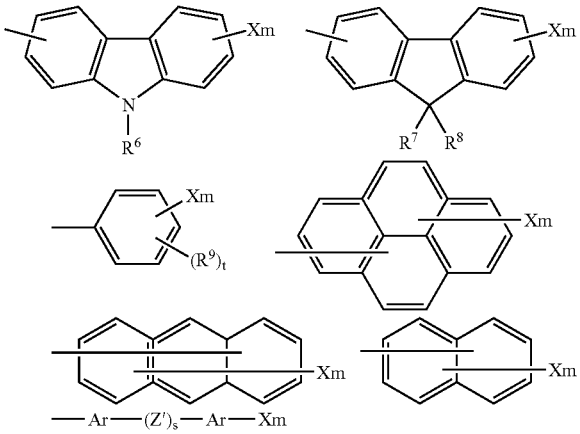

Ar shown in the structure group 1 is selected preferably from the following structure group 2, and Z' is selected preferably from the following structure group 3.

Structure Group 2

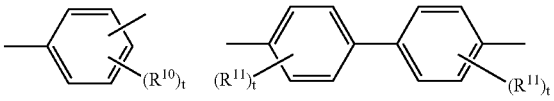

Structure Group 3

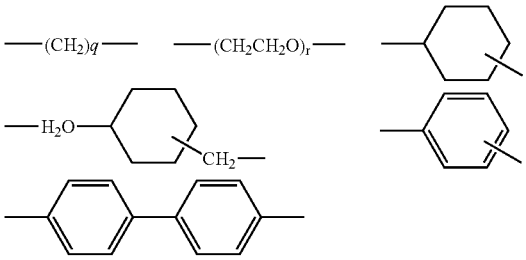

-continued

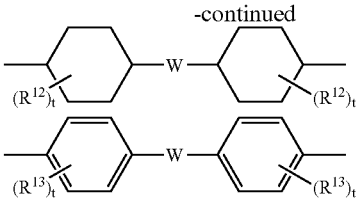

In the structure groups 1 to 3, $R^6$ is selected from hydrogen, a C1 to C4 alkyl group, a phenyl group substituted with a C1 to C4 alkyl group or a C1 to C4 alkoxy group, an unsubstituted phenyl group, and a C7 to C10 aralkyl group.

Each of $R^7$ to $R^{13}$ is selected from hydrogen, a C1 to C4 alkyl group, a C1 to C4 alkoxy group, a phenyl group substituted with a C1 to C4 alkoxy group, an unsubstituted phenyl group, a C7 to C10 aralkyl group, and halogen.

m and s each represent 0 or 1, q and r each represent an integer of 1 to 10, and t represents an integer of 1 to 3. X represents a group represented by $-D-Si(R^2)_{(3-a)}Q_a$ in the formula (I).

W shown in the structure group 3 is represented preferably by the following structure group 4. In the structure group 4,s' is an integer of 0 to 3.

Structure Group 4

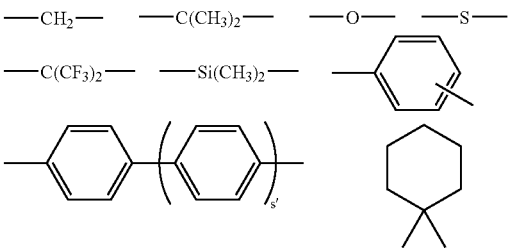

The specific structure of $Ar_5$ in the formula (III), when k=0, includes the structure of $Ar_1$ to $Ar_4$ wherein m=1 shown in the structure group 1, or when k=1, includes the structure of $Ar_1$ to $Ar_4$ wherein m=0 in the structure group 1.

Specific structures of the compounds represented by the formula (III) include compounds (III-1) to (III-61) shown in Table 1 below, but the compounds represented by the formula (III) used in the invention are not limited thereto.

In the structural formulae shown in the items "$Ar_1$" to "$Ar_5$" in Table 1, the benzene ring-bound "-S group" refers to a monovalent group (group corresponding to the structure represented by $-D-Si(R^2)_{(3-a)}Q_a$ in the formula (I)) shown in the item "S" in Table 1.

TABLE 1

| No. | $Ar^1$ | $Ar^2$ | $Ar^3$ |
|---|---|---|---|
| III-1 | 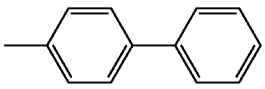 | 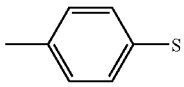 | — |
| III-2 | 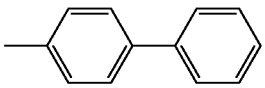 | 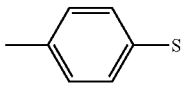 | — |

TABLE 1-continued
| | | | |
|---|---|---|---|
| III-3 | 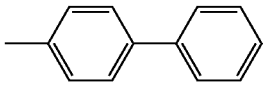 | 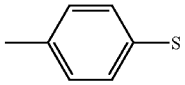 | — |
| III-4 | 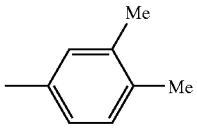 | 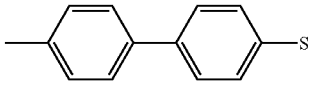 | — |
| III-5 | 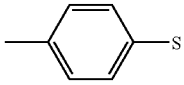 | 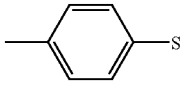 | — |
| III-6 | 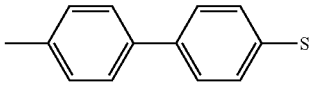 | 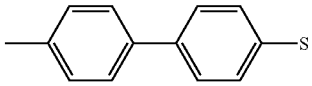 | — |
| III-7 | 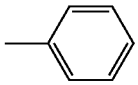 | 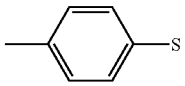 | 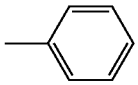 |
| III-8 | 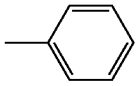 | 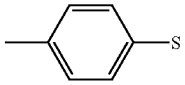 | 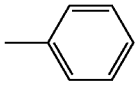 |
| III-9 | 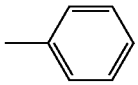 | 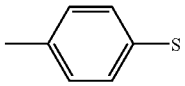 | 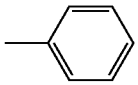 |
| III-10 | 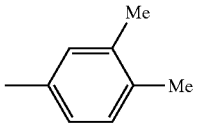 | 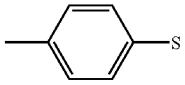 | 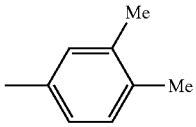 |
| III-11 | 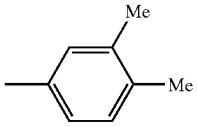 | 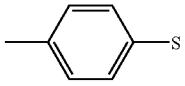 | 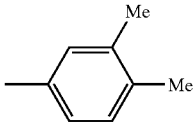 |
| III-12 | 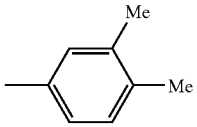 | 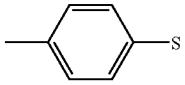 | 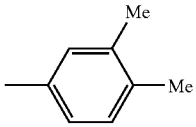 |
| III-13 | 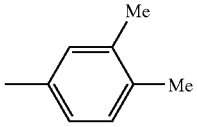 | 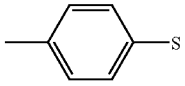 | 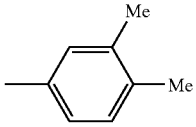 |
| III-14 | 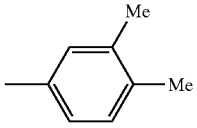 | 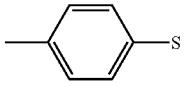 | 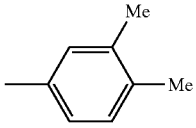 |
| III-15 | 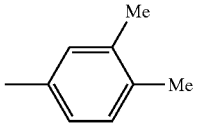 | 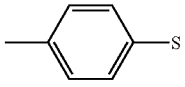 | 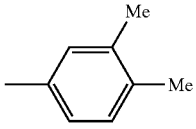 |

TABLE 1-continued
| | | | |
|---|---|---|---|
| III-16 | 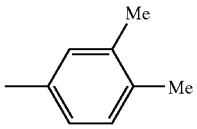 | 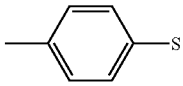 | 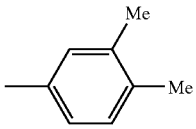 |
| III-17 | 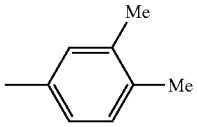 | 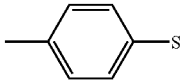 | 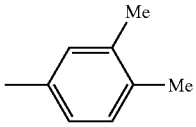 |
| III-18 | 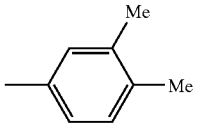 | 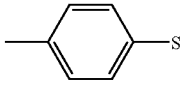 | 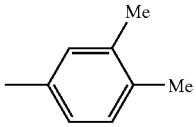 |
| III-19 | 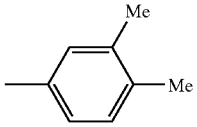 | 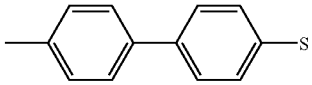 | 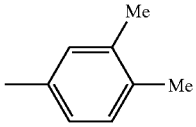 |
| III-20 | 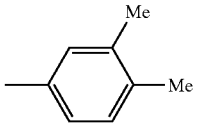 | 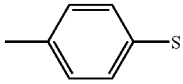 | 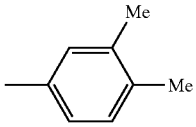 |
| III-21 | 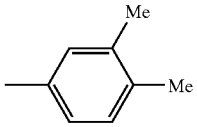 | 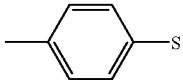 | 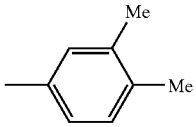 |
| III-22 | 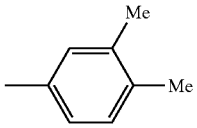 | 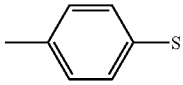 | 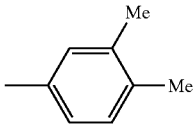 |
| III-23 | 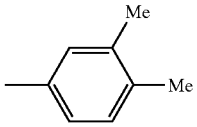 | 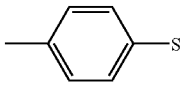 | 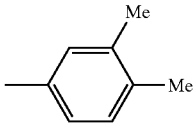 |
| III-24 | 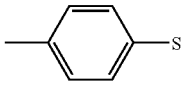 | 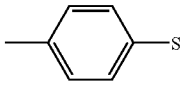 | 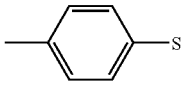 |
| III-25 | 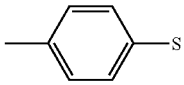 | 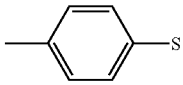 | 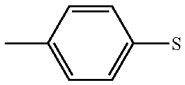 |
| III-26 | 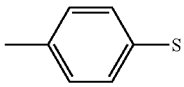 | 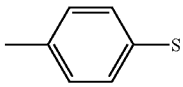 | 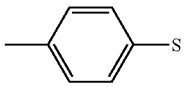 |
| III-27 | 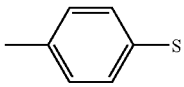 | 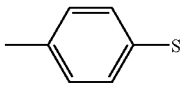 | 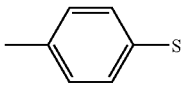 |
| III-28 | 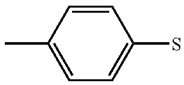 | 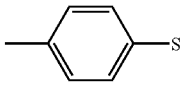 | 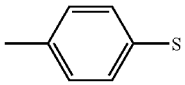 |

TABLE 1-continued
| | | | |
|---|---|---|---|
| III-29 | 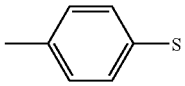 | 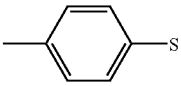 | 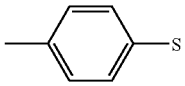 |
| III-30 | 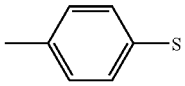 | 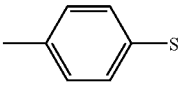 | 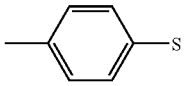 |
| III-31 | 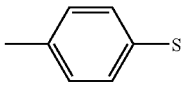 | 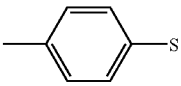 | 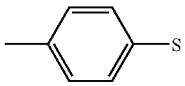 |
| III-32 | 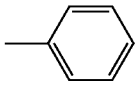 | 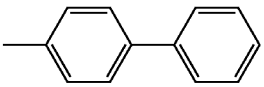 | — |
| III-33 | 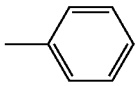 | 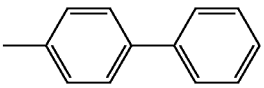 | — |
| III-34 | 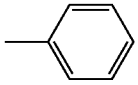 | 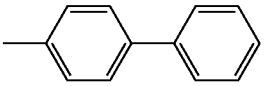 | — |
| III-35 | 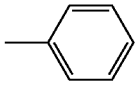 | 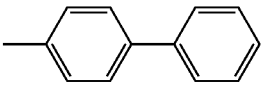 | — |
| III-36 | 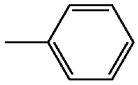 | 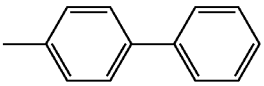 | — |
| III-37 | 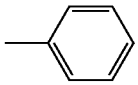 | 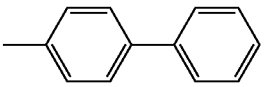 | — |
| III-38 | 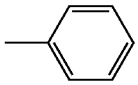 | 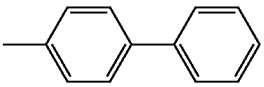 | — |
| III-39 | 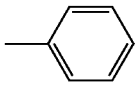 | 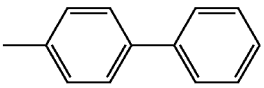 | — |
| III-40 | 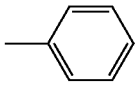 | 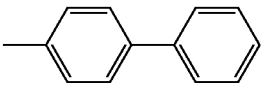 | — |
| III-41 | 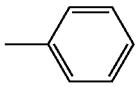 | 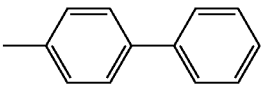 | — |
| III-42 | 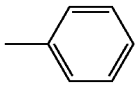 | 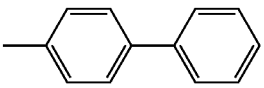 | — |
| III-43 | 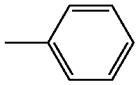 | 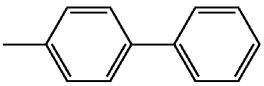 | — |
| III-44 | 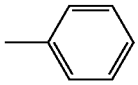 | 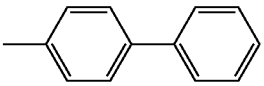 | — |

TABLE 1-continued
| | | | |
|---|---|---|---|
| III-45 | 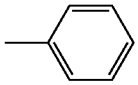 | 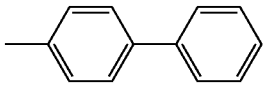 | — |
| III-46 | 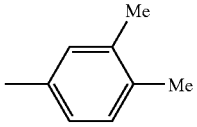 | 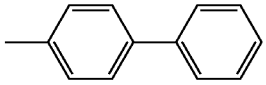 | — |
| III-47 | 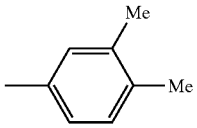 | 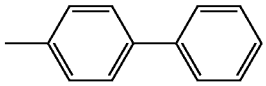 | — |
| III-48 | 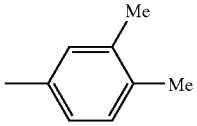 | 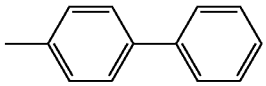 | — |
| III-49 | 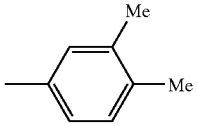 | 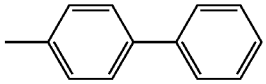 | — |
| III-50 | 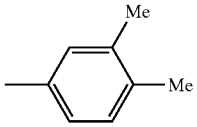 | 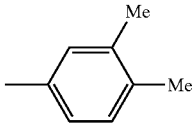 | — |
| III-51 | 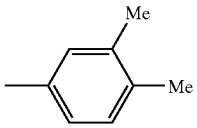 | 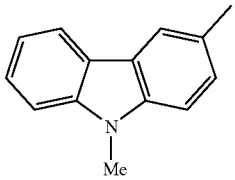 | — |
| III-52 | 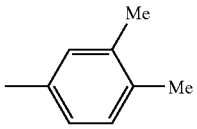 | 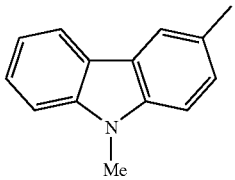 | — |
| III-53 | 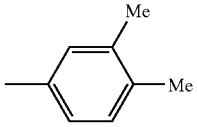 | 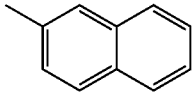 | — |
| III-54 | 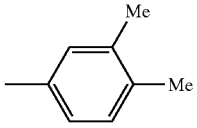 | 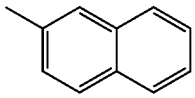 | — |
| III-55 | 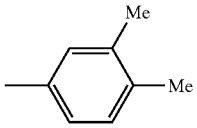 | 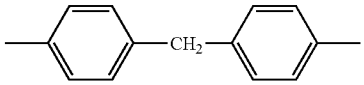 | — |

TABLE 1-continued
| | | | |
|---|---|---|---|
| III-56 | 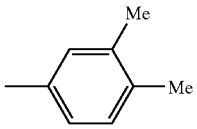 | 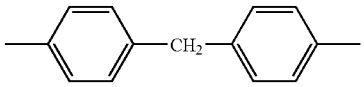 | — |
| III-57 | 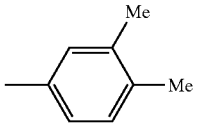 | 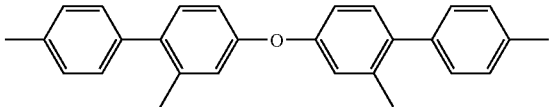 | — |
| III-58 | 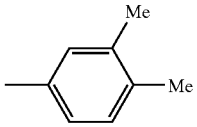 | 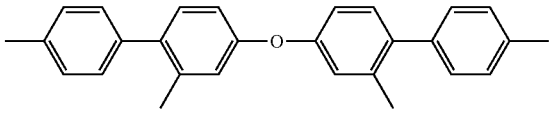 | — |
| III-59 | 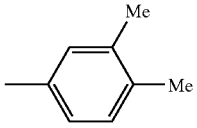 | 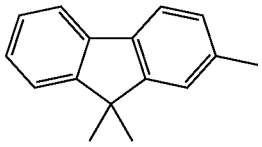 | — |
| III-60 | 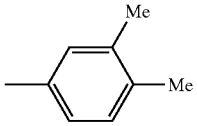 | 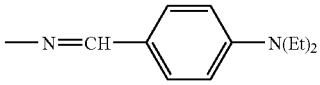 | — |
| III-61 | 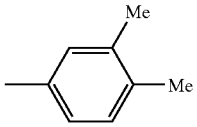 | 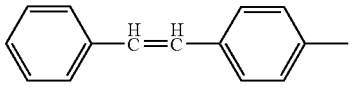 | — |
| No. | $Ar^4$ | $Ar^8$ | k | S |
|---|---|---|---|---|
| III-1 | — | 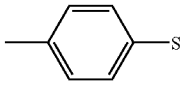 | 0 | —$(CH_2)_2$—COO—$(CH_2)_3$—Si(OiPr)$_2$ |
| III-2 | — | 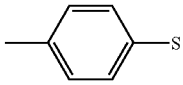 | 0 | —$(CH_2)_2$—COO—$(CH_2)_3$—Si(OiPr)$_2$Me |
| III-3 | — | 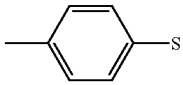 | 0 | —$(CH_2)_2$—COO—$(CH_2)_3$—Si(OiPr)Me$_2$ |
| III-4 | — | 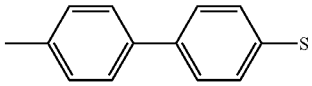 | 0 | —COO—$(CH_2)_3$—Si(OiPr)$_2$ |
| III-5 | — | 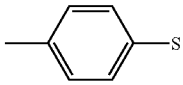 | 0 | —$(CH_2)_2$—COO—$(CH_2)_3$—Si(OiPr)$_2$ |
| III-6 | — | 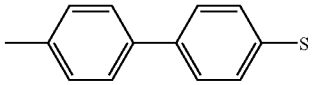 | 0 | —COO—$(CH_2)_4$—Si(OiPr)$_3$ |
| III-7 | 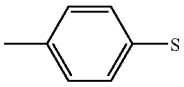 | 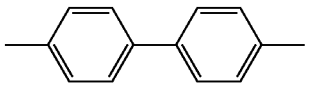 | 1 | —$(CH_2)_4$—Si(OEt)$_3$ |

TABLE 1-continued
| | | | |
|---|---|---|---|
| III-8 | 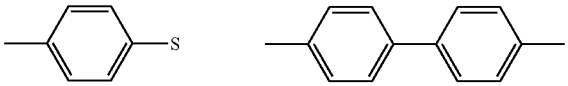 | 1 | —$(CH_2)_4$—$Si(OiPr)_3$ |
| III-9 | 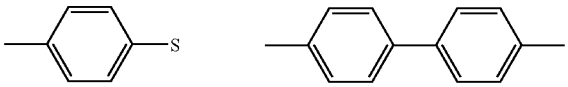 | 1 | —CH═CH—$(CH_2)_2$—$Si(OiPr)_2$ |
| III-10 | 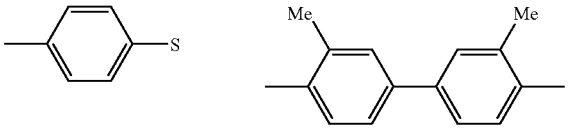 | 1 | —$(CH_2)_4$—$Si(OMe)_2$ |
| III-11 | 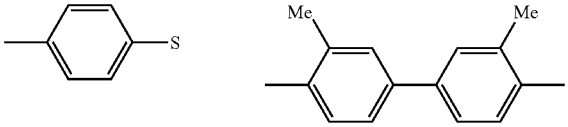 | 1 | —$(CH_2)_4$—$Si(OiPr)_2$ |
| III-12 | 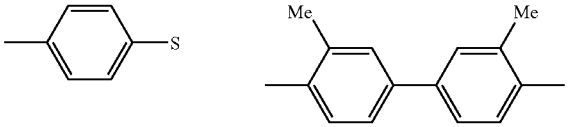 | 1 | —CH═CH—$(CH_2)_2$—$Si(OiPr)_3$ |
| III-13 | 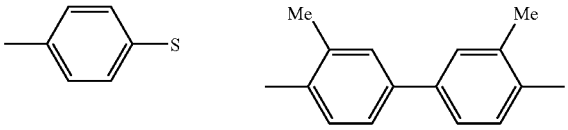 | 1 | —CH═N—$(CH_2)_3$—$Si(OiPr)_3$ |
| III-14 | 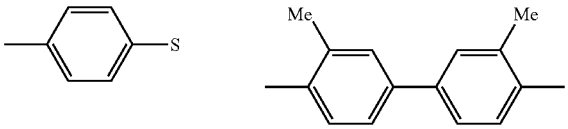 | 1 | —O—$(CH_2)_3$—$Si(OiPr)_3$ |
| III-15 | 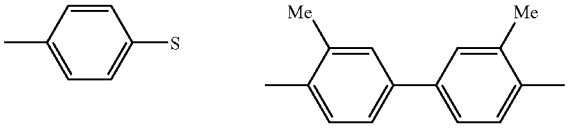 | 1 | —COO—$(CH_2)_3Si(OiPr)_3$ |
| III-16 | 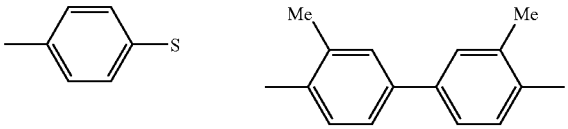 | 1 | —$(CH_2)_2$—COO—$(CH_2)_3$—$Si(OiPr)_3$ |
| III-17 | 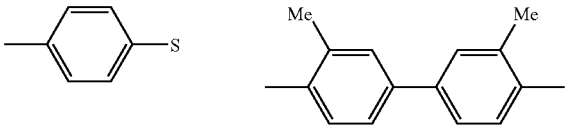 | 1 | —$(CH_2)_2$—COO—$(CH_2)_3$—$Si(OiPr)_2Me$ |
| III-18 | 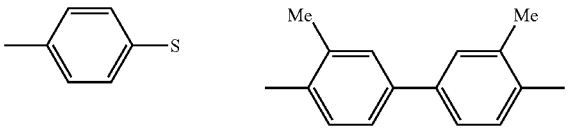 | 1 | —$(CH_2)_2$—COO—$(CH_2)_3$—$Si(OiPr)_2Me$ |
| III-19 | 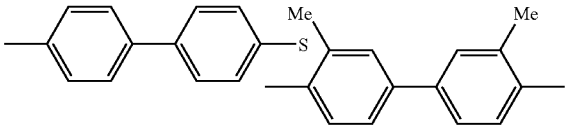 | 1 | —COO—$(CH_2)_3$—$Si(OiPr)_3$ |

TABLE 1-continued

| | | | | |
|---|---|---|---|---|
| III-20 | 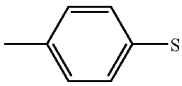 | 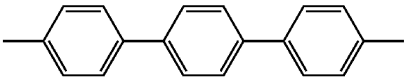 | 1 | —$(CH_2)_4$—Si(OiPr)$_3$ |
| III-21 | 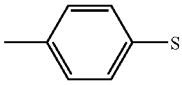 | 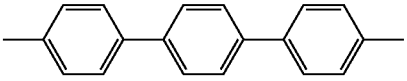 | 1 | —CH═CH—$(CH_2)_2$—Si(OiPr)$_2$ |
| III-22 | 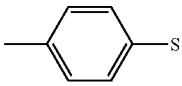 | 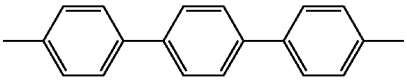 | 1 | —$(CH_2)_2$—COO—$(CH_2)_2$—Si(OiPr)$_3$ |
| III-23 | 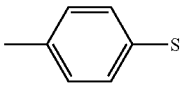 | 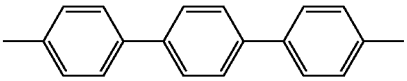 | 1 | —$(CH_2)_2$—COO—$(CH_2)_2$—Si(OiPr)$_2$Me |
| III-24 | 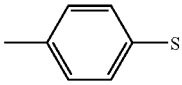 | 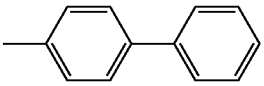 | 1 | —COO—$(CH_2)_3$—Si(OiPr)$_2$ |
| III-25 | 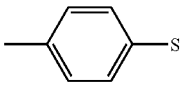 | 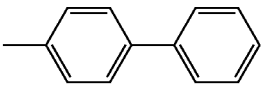 | 1 | —$(CH_2)_3$—COO—$(CH_2)_2$—Si(OiPr)$_2$ |
| III-26 | 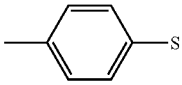 | 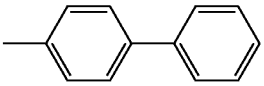 | 1 | —$(CH_2)_3$—COO—$(CH_2)_2$—Si(OiPr)$_2$Me |
| III-27 | 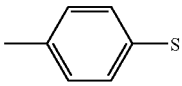 | 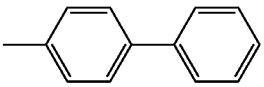 | 1 | —$(CH_2)_3$—COO—$(CH_2)_2$—Si(OiPr)Me$_2$ |
| III-28 | 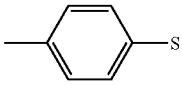 | 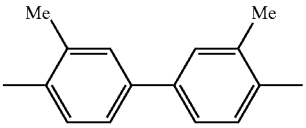 | 1 | —COO—$(CH_2)_3$—Si(OiPr)$_2$ |
| III-29 | 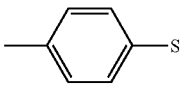 | 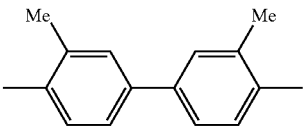 | 1 | —$(CH_2)_3$—COO—$(CH_2)_2$—Si(OiPr)$_2$ |
| III-30 | 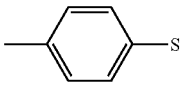 | 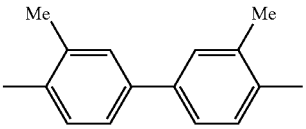 | 1 | —$(CH_2)_3$—COO—$(CH_2)_2$—Si(OiPr)$_2$Me |
| III-31 | 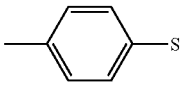 | 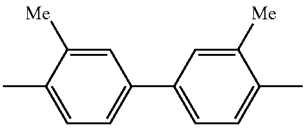 | 1 | —$(CH_2)_3$—COO—$(CH_2)_2$—Si(OiPr)Me$_2$ |
| III-32 | — | 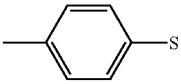 | 0 | —$(CH_2)_4$—Si(OiPr)$_2$ |
| III-33 | — | 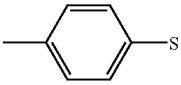 | 0 | —$(CH_2)_4$—Si(OEt)$_2$ |

TABLE 1-continued

| | | | | |
|---|---|---|---|---|
| III-34 | — | 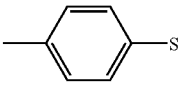 | 0 | —$(CH_2)_4$—$Si(OMe)_2$ |
| III-35 | — | 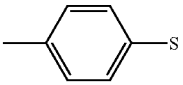 | 0 | —$(CH_2)_4$—$SiMe(OMe)_2$ |
| III-36 | — | 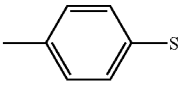 | 0 | —$(CH_2)_4$—$SiMe(OiPr)_2$ |
| III-37 | — | 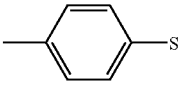 | 0 | —CH═CH—$(CH_2)_2$—$Si(OiPr)_2$ |
| III-38 | — | 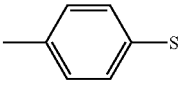 | 0 | —CH═CH—$(CH_2)_2$—$Si(OMe)_2$ |
| III-39 | — | 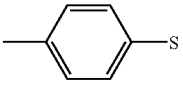 | 0 | —CH═N—$(CH_2)_2$—$Si(OiMe)_2$ |
| III-40 | — | 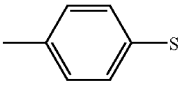 | 0 | —CH═N—$(CH_2)_2$—$Si(OiPr)_2$ |
| III-41 | — | 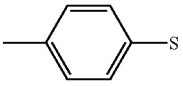 | 0 | —O—$(CH_2)_3$—$Si(OiPr)_2$ |
| III-42 | — | 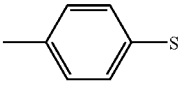 | 0 | —COO—$(CH_2)_3$—$Si(OiPr)_2$ |
| III-43 | — | 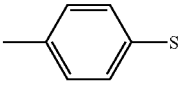 | 0 | —$(CH_2)_3$—COO—$(CH_2)_2$—$Si(OiPr)_2$ |
| III-44 | — | 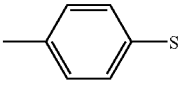 | 0 | —$(CH_2)_3$—COO—$(CH_2)_2$—$Si(OiPr)_2Me$ |
| III-45 | — | 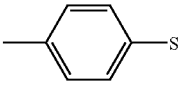 | 0 | —$(CH_2)_3$—COO—$(CH_2)_2$—$Si(OiPr)Me_2$ |
| III-46 | — | 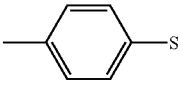 | 0 | —$(CH_2)_4$—$Si(OMe)_2$ |
| III-47 | — | 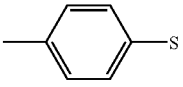 | 0 | —$(CH_2)_3$—COO—$(CH_2)_2$—$Si(OiPr)_2$ |
| III-48 | — | 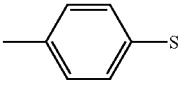 | 0 | —$(CH_2)_3$—COO—$(CH_2)_2$—$SiMe(OiPr)_2$ |

TABLE 1-continued
| | | | | |
|---|---|---|---|---|
| III-49 | — | 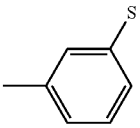 | 0 | —O—$(CH_2)_2$—Si(OiPr)$_2$ |
| III-50 | — | 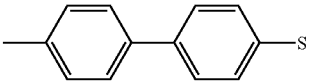 | 0 | —COO—$(CH_2)_2$—Si(OiPr)$_2$ |
| III-51 | — | 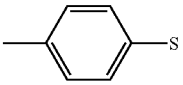 | 0 | —$(CH_2)_4$—Si(OiPr)$_2$ |
| III-52 | — | 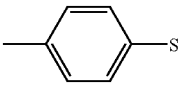 | 0 | —$(CH_2)_2$—COO—$(CH_2)_3$—Si(OiPr)$_2$ |
| III-53 | — | 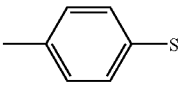 | 0 | —$(CH_2)_4$—Si(OiPr)$_2$ |
| III-54 | — | 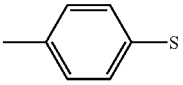 | 0 | —$(CH_2)_2$—COO—$(CH_2)_3$—Si(OiPr)$_2$ |
| III-55 | — | 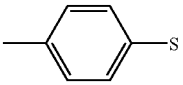 | 0 | —$(CH_2)_4$—Si(OiPr)$_2$ |
| III-56 | — | 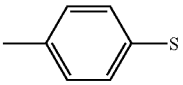 | 0 | —$(CH_2)_2$—COO—$(CH_2)_2$—Si(OiPr)$_2$ |
| III-57 | — | 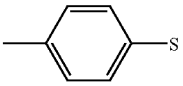 | 0 | —$(CH_2)_4$—Si(OiPr)$_2$ |
| III-58 | — | 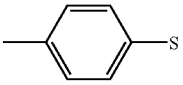 | 0 | —$(CH_2)_2$COO—$(CH_2)_2$—Si(OiPr)$_2$ |
| III-59 | — | 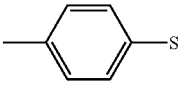 | 0 | —$(CH_2)_2$—COO—$(CH_2)_2$—Si(OiPr)$_2$ |
| III-60 | — | 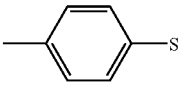 | 0 | —$(CH_2)_2$—COO—$(CH_2)_2$—Si(OiPr)$_2$ |
| III-61 | — | 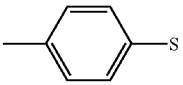 | 0 | —$(CH_2)_2$—COO—$(CH_2)_2$—Si(OiPr)$_2$ |

Specific examples of the formula (II) can include compounds represented by the following formulae (II)-1 to (II)-26, but the invention is not limited thereto.
(II)-1
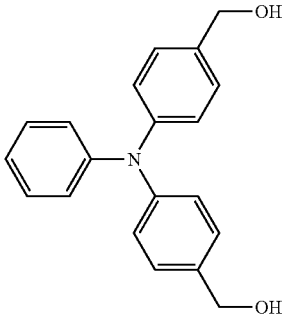
(II)-2
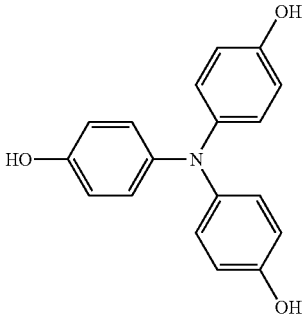
(II)-3
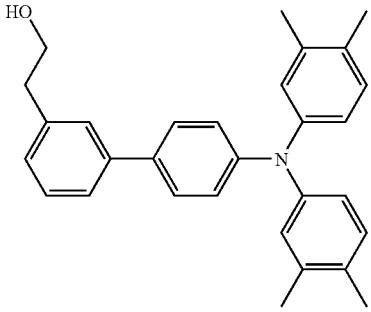
(II)-4
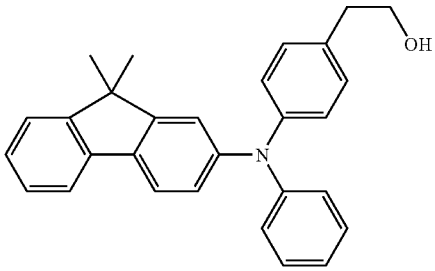
(II)-5
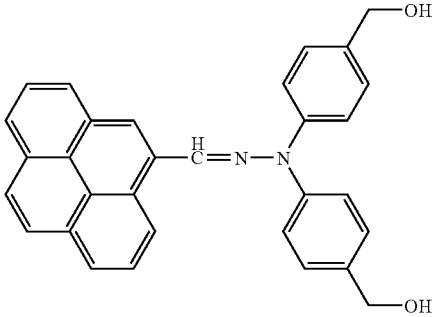
-continued
(II)-6
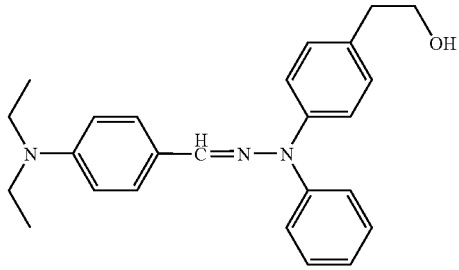
(II)-7
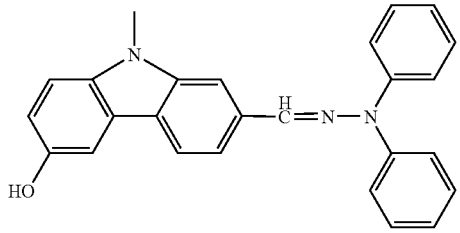
(II)-8
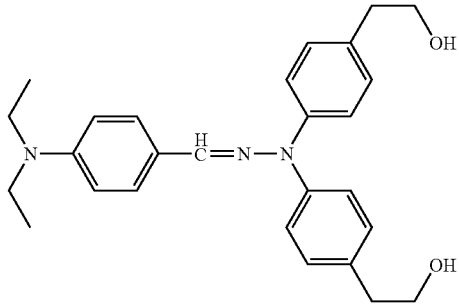
(II)-9
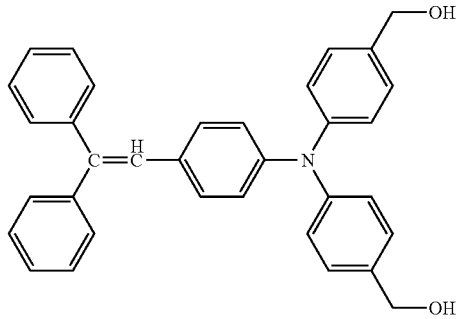
(II)-10
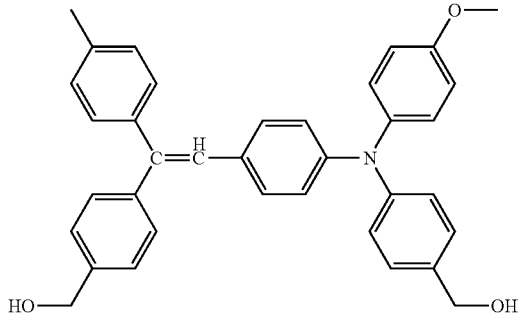

-continued
(II)-11
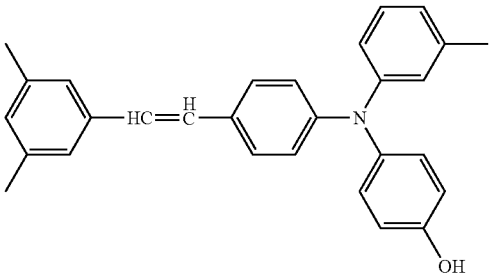
(II)-12
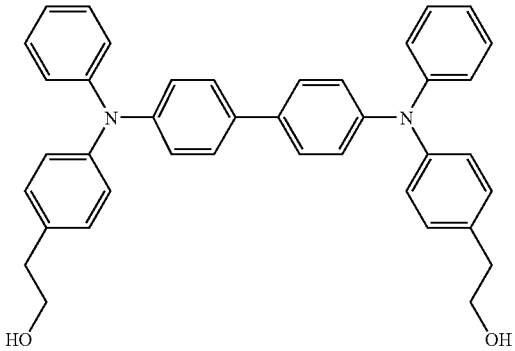
(II)-13
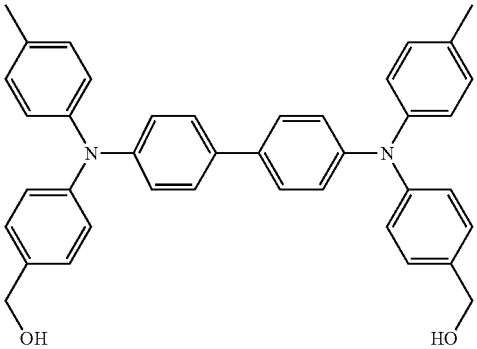
(II)-14
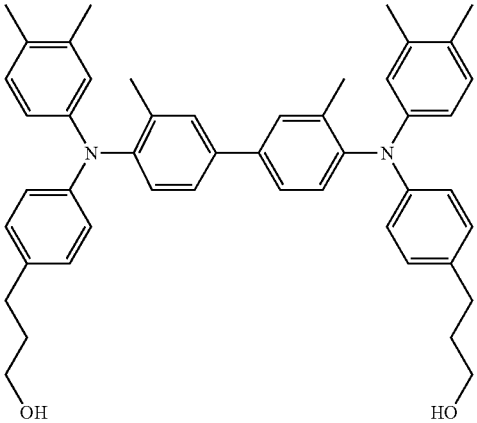
-continued
(II)-15
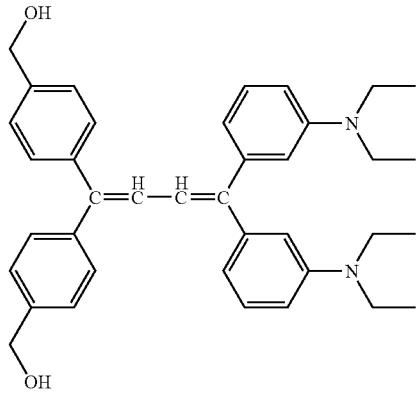
(II)-16
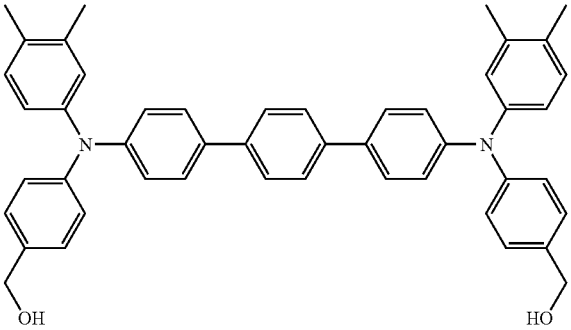
(II)-17
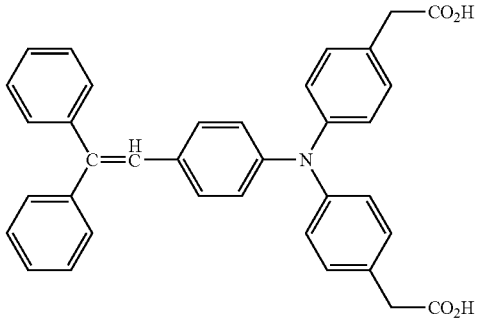
(II)-18
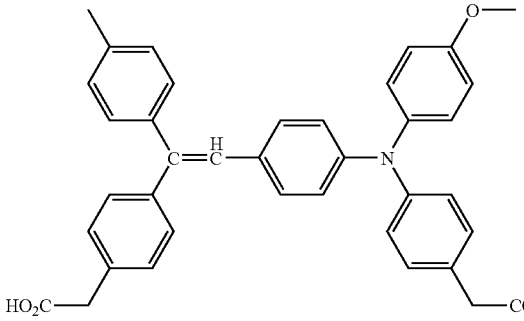

-continued
(II)-19
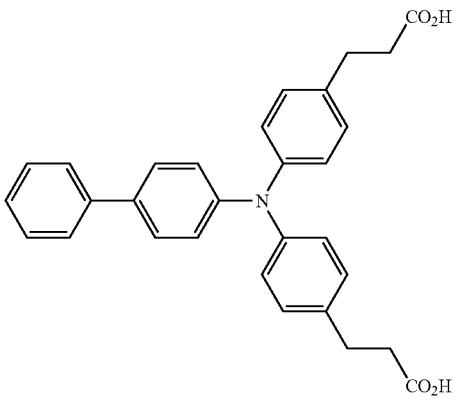
(II)-20
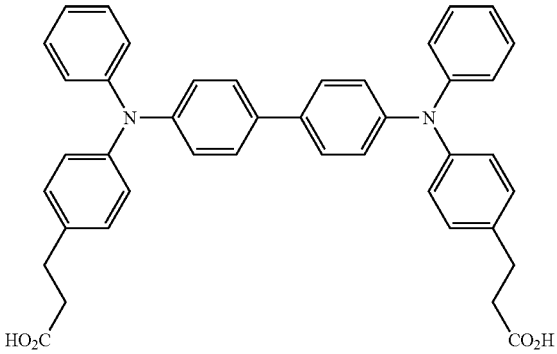
(II)-21
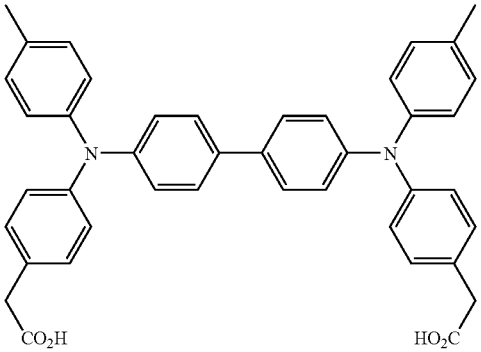
(II)-22
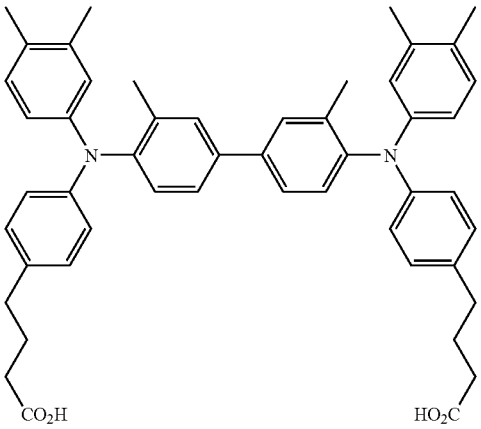
-continued
(II)-23
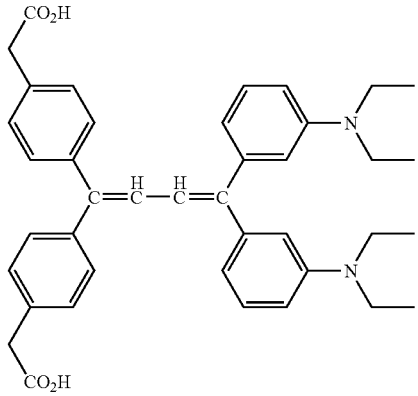
(II)-24
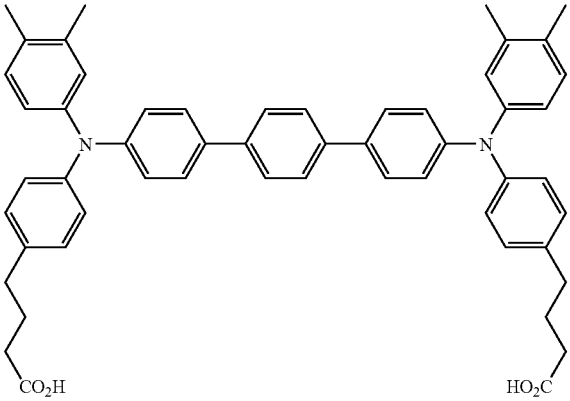
(II)-25
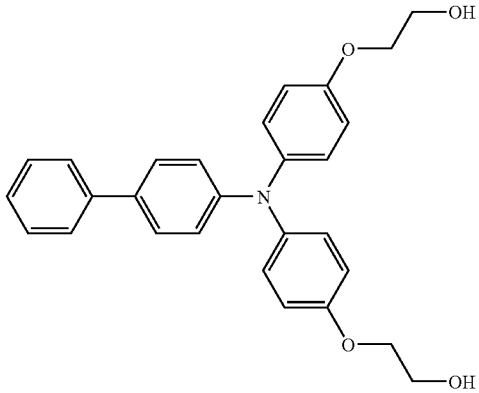
(II)-26
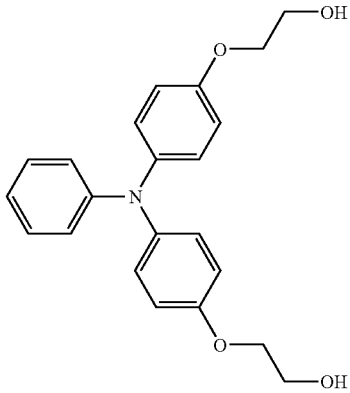

To control various physical properties such as strength and film resistance, it is possible to add a compound represented by the following formula (IV):

$$Si(R^2)_{(4-c)}Q_c \quad (IV)$$

wherein $R^2$ represents hydrogen, an alkyl group or a substituted or unsubstituted aryl group, Q represents a hydrolyzable group, and c is an integer of 1 to 4.

Specific examples of the compound represented by the formula (VI) include the following silane coupling agents: Tetrafunctional alkoxy silane (c=4) such as tetramethoxy silane and tetraethoxy silane; trifunctional alkoxy silane (c=3) such as methyl trimethoxy silane, methyl triethoxy silane, ethyl trimethoxy silane, methyl trimethoxy ethoxy silane, vinyl trimethoxy silane, vinyl triethoxy silane, phenyl trimethoxy silane, γ-glycidoxy propyl methyl diethoxy silane, γ-glycidoxy propyl trimethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, (tridecafluoro-1,1,2,2-tetrahydrooctyl)triethoxy silane, (3,3,3-trifluoropropyl)trimethoxy silane, 3-(heptafluoroisopropoxy)propyl triethoxy silane, 1H,1H,2H,2H-perfluoroalkyl triethoxy silane, 1H,1H,2H,2H-perfluorodecyl triethoxy silane and 1H,1H,2H,2H-perfluorooctyl triethoxy silane; bifunctional alkoxy silane (c=2) such as dimethyl dimethoxy silane, diphenyl dimethoxy silane and methyl phenyl dimethoxy silane; and monofunctional alkoxy silane (c=1) such as trimethyl methoxy silane. For improving film strength, tri- and tetrafunctional alkoxy silane is preferable, and for improving flexibility and film manufacturing, di- and monofunctional alkoxy silane is preferable.

Silicone-based hard coating agent prepared mainly from these coupling agents can also be used As commercial hard coating agent, it is possible to use KP-85, X-40-9740, X-40-2239 (manufactured by Shinetsu Silicone) and AY42-440, AY42-441 and AY49-208 (manufactured by Dow Coming Toray).

To increase strength, it is also preferable to use a compound having two or more silicon atoms represented by the following formula (V):

$$B—(Si(R^2)_{(3-a)})Q_a)_2 \quad (V)$$

wherein B represents a divalent organic group, $R^2$ represents hydrogen, an alkyl group or a substituted or unsubstituted aryl group, Q represents a hydrolyzable group, and a is an integer of 1 to 3.

Specifically, preferable examples include materials shown in Table 2 below, but the invention is not limited thereto.

TABLE 2

| No. | Structural Formula |
|---|---|
| V-1 | $(MeO)_3Si—(CH_2)_2—Si(OMe)_3$ |
| V-2 | $(MeO)_2MeSi—(CH_2)_2—SiMe(OMe)_2$ |
| V-3 | $(MeO)_2MeSi—(CH_2)_6—SiMe(OMe)_2$ |
| V-4 | $(MeO)_3Si—(CH_2)_6—Si(OMe)_3$ |
| V-5 | $(EtO)_3Si—(CH_2)_6—Si(OEt)_3$ |
| V-6 | $(MeO)_2MeSi—(CH_2)_{10}—SiMe(OMe)_2$ |
| V-7 | $(MeO)_3Si—(CH_2)_3—NH—(CH_2)_3—Si(OMe)_3$ |
| V-8 | $(MeO)_3Si—(CH_2)_3—NH—(CH_2)_2—NH—(CH_2)_3—Si(OMe)_3$ |
| V-9 | 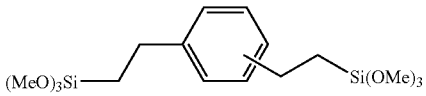 |
| V-10 | 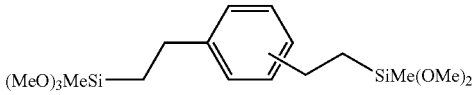 |
| V-11 | 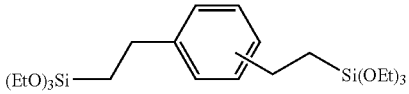 |
| V-12 | 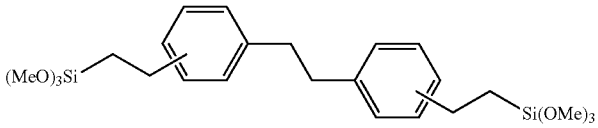 |
| V-13 | 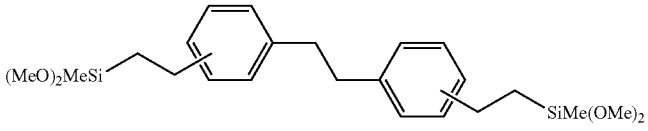 |
| V-14 | 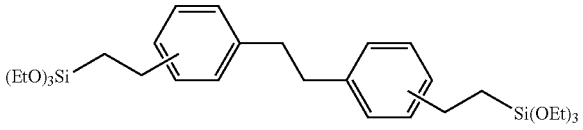 |

TABLE 2-continued

| No. | Structural Formula |
|---|---|
| V-15 | $(MeO)_3SiC_3H_6—O—CH_2CH[—O—C_3H_6Si(OMe)_3]—CH_2\{—O—C_3H_6Si(OMe)_3\}$ |
| V-16 | $(MeO)_3SiC_2H_4—SiMe_2—O—SiMe_2—O—SiMe_2—C_2H_4Si(OMe)_3$ |

For control of film characteristics, prolongation of liquid life, etc., a resin soluble in an alcohol- or ketone-based solvent can be added. Such resin includes polyvinyl butyral resin, polyvinyl formal s polyvinyl acetal resin such as partially acetalated polyvinyl acetal resin having a part of butyral modified with formal, acetoacetal or the like (for example, Esrek B, K etc. manufactured by Sekisui Chemical Co., Ltd.), polyamide resin, cellulose resin, phenol resin etc. Particularly, polyvinyl acetal resin is preferable in respect of electric characteristics.

For the purpose of discharging gas resistance, mechanical strength, mar resistance, particle dispersibility, viscosity control, torque reduction, abrasion control and prolongation of pot life, etc., various resins can be added. A resin soluble in alcohol is preferably added particularly to the siloxane-based resin.

The resin soluble in an alcohol-based solvent includes polyvinyl butyral resin, polyvinyl formal resin, polyvinyl acetal resin such as partially acetalated polyvinyl acetal resin having a part of butyral modified with formal, acetoacetal or the like (for example, Esrek B, K etc. manufactured by Sekisui Chemical Co., Ltd.), polyamide resin, cellulose resin, phenol resin etc. Particularly, polyvinyl acetal resin is preferable in respect of electric characteristics.

The molecular weight of the resin is preferably 2,000 to 100,000, more preferably 5,000 to 50,000. When the molecular weight is less than 2,000, the desired effect cannot be achieved, while when the molecular weigh is greater than 100,000, the solubility is decreased, the amount of the resin added is limited, and coating defects are caused upon coating. The amount of the resin added is preferably 1 to 40 wt %, more preferably 1 to 30 wt %, most preferably 5 to 20 wt %. When the amount is less than 1 wt %, the desired effect is badly obtained, while when the amount is greater than 40 wt %, image blurring may easily occur under high temperature and high humidity. These resins may be used alone or as a mixture thereof.

For prolongation of pot life, control of film characteristics, etc., a cyclic compound having a repeating structural unit represented by the following formula (VI), or a derivative of the compound, can also be contained

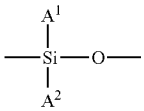

(VI)

In the formula (VI), $A^1$ and $A^2$ independently represent a monovalent organic group.

The cyclic compound having a repeating structural unit represented by the formula (VI) can include commercial cyclic siloxane. Specific examples include cyclic siloxane, for example cyclic dimethyl cyclosiloxane such as hexamethyl cyclotrisiloxane, octamethyl cyclotetrasiloxane, decamethyl cyclopentasiloxane and dodecamethyl cyclohexasiloxane, cyclic methyl phenyl cyclosiloxane such as 1,3,5-trimethyl-1,3,5-triphenyl cyclotrisiloxane, 1,3,5,7-tetramethyl-1,3,5,7-tetraphenyl cyclotetrasiloxane, and 1,3,5,7,9-pentamethyl-1,3,5,7,9-pentaphenyl cyclopentasiloxane, cyclic phenyl cyclosiloxane such as hexaphenyl cyclotrisiloxane, fluorine-containing cyclosiloxane such as 3-(3,3,3-trifluoropropyl)methyl cyclotrisiloxane, a methyl hydroxy siloxane mixture, hydrosilyl group-containing cyclosiloxane such as pentamethyl cyclopentasiloxane and phenyl hydrocyclosiloxane, and vinyl group-containing cyclosiloxane such as pentavinyl pentamethyl cyclopentasiloxane. These cyclic siloxane compounds can be used alone or as a mixture thereof.

To improve the stain resistance and lubricating properties of the surface of the photoreceptor, various fine particles can also be added. Such fine particles can be alone or simultaneously. By way of example, the fine particles include silicon-containing fie particles. The silicon-containing fine particles are fine particles containing silicon as a constituent element, and specifically, colloidal silica and silicone fine particles can be mentioned. The colloidal silica used as the silicon-containing fine particles is selected from acidic or alkaline aqueous dispersions having an average particle diameter of 1 to 100 nm, preferably 10 to 30 nm or those dispersed in an organic solvent such as alcohol, ketone and ester, and generally commercially available products can be used. The solids content of colloidal silica in the outermost surface includes, but is not limited to, 0.1 to 50 wt %, preferably 0.1 to 30 wt %, from the viewpoint of film manufacturing, electric characteristics and strength.

The silicone fine particles used as the silicon-containing fine particles are selected from spherical silicone resin particles, silicone rubber particles and silicone surface-treated silica particles having an average particle diameter of 1 to 500 nm, preferably 10 to 100 nm, and generally commercially available products can be used. The silicone fine particles are chemically inert particles of small diameter excellent in dispersibility in resin, and the content of the silicone fine particles required for further achieving sufficient characteristics is low, so the surface state of the photoreceptor can be improved without inhibiting crosslinking reaction. That is, the silicone fine particles can incorporated uniformly into the rigid crosslinking structure and can simultaneously improve lubricating properties and water repellence of the surface of the photoreceptor and maintain excellent abrasion resistance and stain resistance for a long time. The content of the silicone fine particles in the outermost layer of the photoreceptor in the invention is in the range of 0.1 to 30 wt % of the total solids content of the outermost layer, preferably in the range of 0.5 to 10 wt %.

Other fine particles can include fluorine-based fine particles of ethylene tetrafluoride, ethylene trifluoride, propylene hexafluoride, vinyl fluoride, vinylidene fluoride etc., fine particles consisting of a resin having the fluorine resin copolymerized with a monomer having a hydroxyl group, for example fine particles shown in "Preliminary Collection of Eighth Polymer Material Forum Lectures, p. 89" (in Japanese), and semi-electroconductive metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $In_2O_3$, ZnO and MgO.

For the same purpose, oil such as silicone oil can also be added. The silicone oil includes, for example, silicone oils such as dimethyl polysiloxane, diphenyl polysiloxane and phenyl methyl siloxane, and reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane.

The degree of exposure of the fine particles to the surface of the protective layer is preferably 40% or less. When the degree of exposure is higher than the above range, the influence of the particles themselves is increased, and image flow due to low resistance may occur easily. In the above range, the degree of exposure is more preferably 30 wt % or less, and the particles exposed to the surface are effectively refreshed with a cleaning member, and depression of toner component filming on the surface of the photoreceptor, removal of the electrically discharged residue, and reduction in abrasion of a cleaning member due to torque reduction are maintained for a long period of time.

A plasticizer, a surface modifier, an antioxidant and a photo-deterioration inhibitor can also be used. The plasticizer includes, for example, biphenyl, biphenyl chloride, terphenyl, dibutyl phthalate, diethylene glycol phthalate, dioctyl phthalate, triphenyl phosphoric acid, methylnaphthalene, benzophenone, chlorinated parffin polypropylene, polystyrene and various fluorohydrocarbons.

An antioxidant having a hindered phenol, hindered amine, thioether or phosphite partial structure can be added to the protective layer, and is effective in improving potential stability and image qualities when the environment is changed. The antioxidant includes the following compounds, for example, hindered phenol antioxidants such as "Sumilizer BHT-R", "Sumilizer MDP-S", "Sumilizer BBM-S", "Sumilizer WX-R", "Sumilizer NW", "Sumilizer BP-76", "Sumilizer BP-101", "Sumilizer GA-80", "Sumilizer GM" and "Sumilizer GS" manufactured by Sumitomo Chemical, "IRGANOX1010", "IRGANOX1035", "IRGANOX1076", "IRGANOX1098", "IRGANOX1135", "IRGANOX1141", "IRGANOX1222", "IRGANOX1330", "IRGANOX1425WL", "IRGANOX1520L", "IRGANOX245", "IRGANOX259", "IRGANOX3114", "IRGANOX3790", "IRGANOX5057" and "IRGANOX565" manufactured by Ciba Specialty Chemicals, "Adekastab AO-20", "Adekastab AO-30", "Adekastab AO-40", "Adekastab AO-50", "Adekastab AO-60", "Adekastab AO-70", "Adekastab AO-80" and "Adekastab AO-330" manufactured by Asahi Denka, hindered amine antioxidants such as "Sanol LS2626", "Sanol LS765", "Sanol LS770", "Sanol LS744", "Tinubin 144", "Tinubin 622LD", "Mark LA57", "Mark LA67", "Mark LA62", "Mark LA68", "Mark LA63" and "Sumilizer TPS", thioether antioxidants such as "Sumilizer TP-D", phosphite antioxidants such as "Mark 2112", "Mark PEP-8", "Mark PEP-24G", "Mark PEP-36", "Mark 329K" and "Mark HP-10", and particularly hindered phenol or hindered amine antioxidants are preferable. These may be modified with substituent groups such as an alkoxysilyl group capable of crosslinkage reaction with a material forming a crosslinked film.

A catalyst is added or used in a coating solution used in forming the protective layer or at the time of preparing the coating solution. The catalyst used includes inorganic acids such as hydrochloric acid, acetic acid, phosphoric acid and sulfuric acid, organic acids such as formic acid, propionic acid, oxalic acid, p-toluenesulfonic acid, benzoic acid, phthalic acid and maleic acid, and alkali catalysts such as potassium hydroxide, sodium hydroxide, calcium hydroxide, ammonia and triethylamine, and the following solid catalysts insoluble in the system.

Examples of the insoluble solid catalysts include cation exchange resins such as Amberlite 15, Amberlite 200C and Amberlist 15E (manufactured by Rohm and Haas); Dow X MWC-1-H, Dow X 88 and Dow X HCR-W2 (manufactured by Dow Chemical); Levatit SPC-108 and Levatit SPC-118 (manufactured by Bayer); Diaion RCP-150H (manufactured by Mitsubishi Chemical Industries); Sumika Ion KC470, Duolite C26-C, Duolite C433 and Duolite464 (manufactured by Sumitomo Chemical); and Naphion-H (manufactured by DuPont); anion exchange resins such as Amberlite IRA-400 and Amberlite IRA-45 (manufactured by Rohm and Haas); inorganic solids having groups containing protonic acid groups such as $Zr(O_3PCH_2CH_2SO_3H)_2$ and $Th(O_3PCH_2CH_2COOH)_2$ bound to the surface thereof; polyorganosiloxane containing protonic acid groups, such as polyorganosiloxane having sulfonic acid groups; heteropoly acids such as cobalt tungstic acid and phosphomolybdic acid; isopoly acids such as niobic acid, tantalic acid and molybdic acid; mono metal oxides such as silica gel, alumina, chromia, zirconia, CaO and MgO; composite metal oxides such as silica-alumina, silica-magnesia, silica-zirconia, and zeolite; clay minerals such as acidic clay, active clay, montmorilonite and kaolinite; metal sulfates such as $LiSO_4$ and $MgSO_4$; metal phosphates such as zirconia phosphate and lanthanum phosphate; metal nitrates such as $LiNO_3$ and $Mn(NO_3)_2$; inorganic solids having amino group-containing groups bound to the surface thereof, such as solids obtained by reacting aminopropyl triethoxy silane with silica gel; and polyorganosiloxane containing amino groups, such as amino-modified silicone resin.

It is preferable that a solid catalyst insoluble in a photofunctional compound, reaction products, water and solvent is used in preparing the coating solution, because the stability of the coating solution tends to be improved. The solid catalyst insoluble in the system is not particularly limited insofar as the catalyst component is insoluble in a compound represented by the formula (I), (II), (III) or (V), or other additives, water, solvent etc. The amount of the solid catalyst used is not particularly limited and is preferably 0.1 to 100 parts by weight relative to 100 parts in total by weight of compounds having a hydrolyzable group.

As described above, the solid catalyst is insoluble in the starting compounds, reaction products and solvent, and can thus be easily removed in a usual manner after the reaction. The reaction temperature and reaction time are selected suitably depending on the type and amount of the starting compounds and solid catalyst used, but usually the reaction temperate is 0 to 100° C., preferably 10 to 70° C., more preferably 15 to 50° C. and the reaction time is preferably 10 minutes to 100 hours When the reaction time is longer than the upper limit mentioned above, gelation tends to occur easily.

When the catalyst insoluble in the system is used in the step of preparing the coating solution, a catalyst dissolved in the system is preferably simultaneously used for the purpose of improving strength, liquid storage stability, etc. As the catalyst, it is possible to use not only the above-mentioned catalysts but also organoaluminum compounds such as aluminum triethylate, aluminum triisopropylate, aluminum tri(sec-butyrate), mono(sec-butoxy) aluminum diisopropylate, diisopropoxy aluminum (ethyl acetoacetate), aluminum tris(ethyl acetoacetate), aluminum bis(ethyl acetoacetate) monoacetyl acetonate, aluminum tris(acetyl acetonate), aluminum diisopropoxy (acetyl acetonate), aluminum isopropoxy-bis(acetyl acetonate), aluminum tris(trifluoroacetyl acetonate), aluminum tris(hexafluoroacetyl acetonate), etc.

In addition to the organoaluminum compounds, it is also possible to use organotin compounds such as dibutyltin dilaurate, dibutyltin dioctiate and dibutyltin diacetate; organotitanium compounds such as titanium tetrakis(acetyl acetonate), titanium bis(butoxy)bis(acetyl acetonate) and titanium bis (isopropoxy)bis(acetyl acetonate); and zirconium compounds such as zirconium tetrakis(acetyl acetonate), zirconium bis(butoxy)bis(acetyl acetonate) and zirconium bis (isopropoxy)bis(acetyl acetonate), but from the viewpoint of safety, low cost, and pot-life length, the organoaluminum compounds are preferably used, and particularly the aluminum chelate compounds are more preferable. The amount of these catalysts used is not particularly limited and is preferably 0.1 to 20 parts by weight, more preferably 0.3 to 10 parts by weight, relative to 100 parts in total by weight of compounds having a hydrolyzable group.

When the organometallic compound is used as a catalyst, a multidentate ligand is preferably added from the viewpoint of pot life and curing efficiency. The multidentate ligand includes the following ligands and ligands derived therefrom, bin the invention is not limited thereto.

Specific examples include β-diketones such as acetyl acetone, trifluoroacetyl acetone, hexafluoroacetyl acetone and dipivaloyl methyl acetone; acetoacetates such as methyl acetoacetate and ethyl acetoacetate; bipyridine and derivatives thereof; glycine and derivatives thereof; ethylene diamine and derivatives thereof, 8-oxoquinoline and derivatives thereof; salicylaldehyde and derivatives thereof; catechol and derivatives thereof; bidentate ligands such as 2-oxyazo compounds; diethyl triamine and derivatives thereof; tridendate ligands such as nitrilotriacetic acid and derivatives thereof; and hexadentate ligands such as ethylenediaminetetraacetic acid (EDTA) and derivatives thereof. In addition to the organic ligands described above, inorganic ligands such as polyphosphoric acid and triphosphoric acid can be mentioned. The multidentate ligand is particularly preferably a bidentate ligand, and specific examples include bidentate ligands represented by the formula (VII) in addition to those described above. Among these ligands, the bidentate ligands represented by formula (VII) below are more preferable, and those of the formula (VII) wherein $R^5$ is the same as $R^6$ are particularly preferable. When $R^5$ is the same as $R^6$, the coordination strength of the ligand in the vicinity of room temperature can be increased to achieve further stabilization of the coating solution.

(VII)

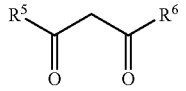

In the formula (VI), $R^5$ and $R^6$ independently represent a C1 to C10 alkyl group, an alkyl fluoride group, or a C1 to C10 alkoxy group.

The amount of the multidentate ligand incorporated can be arbitrarily established, but it is preferable that the amount is 0.01 mole or more, preferably 0.1 mole or more, more preferably 1 mole or more, relative to 1 mole of the organometallic compound used.

Production of the coating solution can also be conducted in the absence of a solvent, but if necessary it is possible to use various solvents in addition to alcohols such as methanol, ethanol, propanol and butanol; ketones such as acetone and methyl ethyl ketone; and ethers such as tetrahydrofuran, diethyl ether and dioxane. Such solvents preferably have a boiling point of 100° C. or less and can be arbitrarily mixed for use. The amount of the solvent can be arbitrarily established, but when the amount is too low, the organosilicon compound is easily precipitated, so it is preferable that the amount of the solvent is preferably 0.5 to 30 parts by weight, preferably 1 to 20 parts by weight, relative to 1 part by weight of the organosilicon compounds.

The reaction temperature and reaction time for curing the coating solution are not particularly limited, but from the viewpoint of the mechanical strength and chemical stability of the resulting silicon resin, the reaction temperature is preferably 60° C. or more, more preferably 80 to 200° C., and the reaction time is preferably 10 minutes to 5 hour. To allow a protective layer obtained by curing the coating solution to be kept in a highly humid state is effective in improving the properties of the protective layer. Depending on applications, the protective layer can be hydrophobated by surface treatment with hexamethyl disilazne or trimethyl chlorosilane.

The resin layer having charge transportability and also containing a resin having a crosslinked structure has excellent mechanical strength and satisfactory photoelectric properties, and can thus be used directly as a charge transport layer in a photoreceptor of laminate type. In this case, a usual method such as blade coating, Meyer bar coating, spray coating, dipping coating, bead coating, air knife coating and curtain coating can be used. However, when necessary film thickness cannot be obtained by applying the coating solution once, the coating solution can be applied repeatedly to attain necessary film thickness. When the coating solution is applied repeatedly, heat treatment may be carried out after each application or after repeated application.

A photoreceptor of single layer type is formed by incorporation of the charge generation material and a binder resin. The binder resin can be the same as used in the charge generation layer and the charge transport layer. The content of the charge generation material in the photoreceptor of single layer type is about 10 to 85 wt %, preferably 20 to 50 wt %. For the purpose of improving photoelectric properties etc., the charge transport material and polymer charge transport material may be added to the photoreceptor of single layer type. The amount thereof is preferably 5 to 50 wt %. The compound represented by the formula (I) may also be added. As the solvent used in coating and the coating method, those described above can be used The thickness of the coating is preferably about 5 to 50 μm, more preferably 10 to 40 μm.

—Toner—

As a toner to be used for the image forming apparatus comprising the process cartridge and the cleaning apparatus or the image forming apparatus of the invention, conventionally known toners are used without any particular limit, however the toner is preferable to have a shape factor SF less than 140. If the shape factor SF exceeds 140, it may become difficult to obtain a good transferring property and to give an image with a high image quality in some cases.

The shape factor SF is a value defined by the following equation (8)

$$SF=ML^2/(4A/\pi) \quad \text{Equation (8)}$$

wherein ML represents the maximum length (μm) of the toner; A represents the projected surface area ($\mu m^2$) of the toner.

The shape factor SF can be measured using a LUZEX image analyzer (FT, manufactured by NIRECO Corp.) as follows.

At first, an optical microscopic image of a toner sprayed on a slide glass is taken in the LUZEX image analyzer by a video camera and the maximum length (ML) and the projected surface area (A) of 50 toner particles are measured. Next, (the square of the maximum value)/(4×projected surface area (π)), that is, $ML^2/(4A/\pi)$, is calculated for respective toner particles and the average of the respective values is defined as the shape factor SF.

On the other hand, the toner to be used in the invention is preferable to have a volume average particle diameter in a range of 2 to 8 μm to obtain high quality images.

The toner to be used in the invention contains a binder resin and a coloring agent as indispensable components and if necessary, a releasing agent and other additives. As the binder resin, binder resins conventionally used for toners may be used without any particular limit.

Practical examples of the binder resin are homopolymers of monomers, for example, styrenes such as styrene, p-chlorostyrene and α-methylstyrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylenic unsaturated acid monomers such as acrylic acid, methacrylic acid, and sodium styrenesulfonate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene; copolymers of two or more of these monomers; and mixtures of the homopolymers and copolymers.

Further, mixtures of these homopolymers, copolymers, and mixtures mixed with non-vinyl condensation type resins such as epoxy resins, polyester resins, polyurethane resins, polyamide resins, cellulose resins, and polyether resins, or mixtures with the above-mentioned vinyl type resins, and graft polymers obtained by polymerization of vinyl type monomers in co-presence of these polymers and mixtures can be exemplified.

As the coloring agent, conventionally known coloring agents may be used without any particular limit. Various types of pigments such as carbon black, Chrome Yellow, Hansa Yellow, Benzidine Yellow, Threne Yellow, Quinoline Yellow, Permanent orange GTR, Pyrazolone Orange, Vulcan Orange, Watchung Red, Permanent Red, Brilliant Carmine 3B, Brilliant Carmine 6B, Du-pont Oil Red, Pyrazolone Red, Lithol Red, Rhodamine B Lake, Lake Red C, Rose Bengal Aniline Blue, Ultramarine Blue, Chalco Oil Blue, Methylene Blue Chloride, Phthalocyanine Blue, Phthalocyanine Green, and Malachite Green Oxalate; and various types of dyes such as acridine, xanthene, azo, benzoquinone, azine, anthraquinone, thioindigo, dioxazine, thiazine, azotmethine, indigo, phthalocyanine, aniline black, polymethine, triphenylmethane, diphenyl methane, and thioazole types, and these pigment and dyes can be used alone or two or more of them may be use in combination.

Examples of substances to be added based on the necessity as a releasing agent to the toner used in the invention are low molecular weight polyolefins such as polyethylene, polypropylene, and polybutene; silicone oils; fatty acid amides such as oleic acid amide, erucic acid amide, ricinoleic acid amide, and stearic acid amide; plant type waxes such as carnauba wax, rice wax, candelilla wax, haze wax, and jojoba wax; animal type waxes such as bees wax, mineral type or petroleum type waxes such as montan wax, ozocerite, ceresine, paraffin wax, microcrystalline wax, and Fischer-Tropsch wax and their denatured products. At least one of these waxes may be added in toner particles.

To control various properties, various kinds of components other than the above-mentioned components can be added to the toner. For example, in the case of using the toner as a magnetic toner, magnetic powders (e.g. ferrite and magnetite), metals as reduced iron, cobalt, nickel and manganese, and alloys and compounds containing such metals may be added. Further based on the necessity, commonly used charge control agents such as quaternary ammonium salts, Nigrosine type compounds and tripbenylmethane type pigments may properly be selected and added.

A method of producing the toner to be used in the invention is not particularly limited and already known toner production method by, for example, conventional pulverization method, wet melt-spheroidizing method for production in a dispersion medium, and conventionally known polymerization methods such as suspension polymerization, dispersion polymerization, emulsion-polymerization aggregation process can be employed.

The toner to be used in the invention may be mixed additionally with a proper amount of inorganic fine particles such as silica and titania with an average particle size of 10 to 300 nm, an abrasive with about 0.2 to 3 μm, and a lubricant with about 3 to 15 μm. The-toner obtained in such a manner can be mixed with a carrier such as ferrite beads with an average particle diameter of 35 μm to obtain a two-component type developer.

—Practical Example of Cleaning Blade, Image Forming Apparatus, and Cleaning Apparatus—

Next, practical examples of a cleaning blade of the invention, and an image forming apparatus and a cleaning apparatus using the cleaning blade will be described in detail along with drawings.

FIG. 1 is a schematic view showing one example of an image forming apparatus of the invention, so-called tandem type image forming apparatus.

In FIG. 1, 21 is a main body housing; 22, 22*a* to 22*d* are an image forming engine; 23 is a belt module; 24 is a recording material supply cassette; 25 is a recording material transport path; 30 is each photoreceptor unit; 31 is a photoreceptor drum; 33 is each developing unit; 34 is a cleaning apparatus; 35, 35*a* to 35*d* are a toner cartridge; 40 is an exposure unit; 41 is a unit case; 42 is a polygonal mirror, 51 is a primary transfer apparatus; 52 is a secondary transfer apparatus; 53 is a belt cleaning apparatus; 61 is a feed roll; 62 is a take-away-roll; 63 is a resist roll; 66 is a fixing apparatus; 67 is a discharge roll; 68 is a discharge tray; 71 is manual feeding apparats; 72 is a feed roll; 73 is a double-side recording unit; 74 is a guide roll; 76 is a transport path; 77 is a transport roll; 230 is an intermediate transfer belt; 231 and 232 are over-striding rolls; 521 is a secondary transfer roll; and 531 is a cleaning blade.

The tandem type image forming apparatus shown in FIG. 1 comprises four color (Black, Yellow, Magenta, and Cyane in this embodiment) image forming engines 22 (concretely 22*a* to 22*d*) arranged transversely in the main body housing 21; the belt module 23 comprising the intermediate transfer belt 230 circularly transported along the arrangement direction of the respective image forming engines 22 disposed above the engines; a recording material supply cassette 24, in which recording material (not illustrated) such as paper is housed, in a lower part of the main body housing 21; and a recording material transport path 25, which is to be a transport path of the recording material from the recording material supply cassette 24, arranged vertically.

In this embodiment, the respective image forming engines 22 (22*a* to 22*d*) are for forming toner images successively from the upstream side in the circulation direction of the intermediate transfer belt 230, for example, toner images for black, yellow, magenta, and cyane (the arrangement is not necessarily in this order) and the engines respectively comprise a photoreceptor unit 30, a developing unit 33, and a single exposure unit 40 to be used in common.

The photoreceptor unit 30 is made in a cartridge type by unitedly assembling, for example, the photoreceptor drum 31, a charging apparatus (in FIG. 1, not illustrated, the charging roll 32 shown in FIG. 2, which will be described later) for previously charging the photoreceptor drum 31, and a cleaning apparatus 34 for removing residual toner on the photoreceptor drum 31.

The developing unit 33 is for developing color toners (in this embodiment, negative polarity) corresponding to electrostatic latent images exposed on the charged photoreceptor drum 31 by the exposure unit 40 and is united with a sub cartridge comprising, for example, a photoreceptor unit 30 to compose a process cartridge (so-called CRU: Customer Replaceable Unit).

The photoreceptor unit 30 may be separated form the developing unit 33 to be CRU alone. In FIG. 1, the reference numeral 35 (35*a* to 35*d*) denote toner cartridges for supplying respective color component toners to the respective developing units 33 (toner supplying paths are not illustrated).

On the other hand, the exposure unit 40 houses, for example, four semiconductor lasers (not illustrated), one polygonal mirror 42, a imaging lens (not illustrated), and respective mirrors (not illustrated) corresponding to the respective photoreceptor units 30 in a unit case 41 and so constructed as to carry out deflecting and scanning light from the semiconductor laser for each color component by the polygonal mirror 42 and lead a light image on the corresponding exposure point on the photoreceptor drum 31 via the imaging lens and mirror.

In this embodiment, the belt module 23 is composed by striding the intermediate transfer belt 230 between a pair of over-striding rolls (one is a driving roll) 231 and 232 and the primary transfer apparatus (in this example, a primary transfer roll) 51 is installed in the back face of the intermediate transfer belt 230 corresponding to the photoreceptor drum 31 of each photoreceptor unit 30 and a toner image on the photoreceptor drum 31 is electrostatically transferred to the intermediate transfer belt 230 side by applying voltage with polarity opposite to the charge polarity of the toner to the primary transfer apparatus 51. The secondary transfer apparatus 52 is installed at a position corresponding to a striding-over roll 232 in the downstream side of the image forming engine 22*d* in the most downstream side of the intermediate transfer belt 230 so as to secondarily transfer (collectively transfer) the primarily transferred image on the intermediate transfer belt 230 to the recording material.

In this embodiment, the secondary transfer apparatus 52 comprises a secondary transfer roll 521 installed while being pushed to the toner image bearing face of the intermediate transfer belt 230 and a back up roll (in this example used as the striding-over roll 232 in common) forming a counter electrode of the secondary transfer roll 521 in the back face side of the intermediate transfer belt 230. The secondary transfer roll 521 is earthed and bias with the same polarity as charge polarity of the toner is applied to the back up roll (the striding-over roll 232).

Further, a belt cleaning apparatus 53 is installed in the upstream side of the image forming engine 22*a* in the most upon side of the intermediate transfer belt 230 so as to remove the residual toner on the intermediate transfer belt 230.

Further, in the recording material supply cassette 24, a feed roll 61 for picking-up a recording material is installed and the take-away roll 62 for sending the recording material is installed immediately behind the feed roll 61 and also a registration roll 63 for supplying the recording material to the secondary transfer position at a predetermined timing is installed in the recording material transfer path 25 positioned immediately before the secondary transfer position. On the other hand, the fixing apparatus 66 is installed in the recording material transfer path 25 positioned in the downstream side of the secondary transfer position and a discharge roll 67 for discharging the recording material is installed in the downstream side of the fixing apparats 66 and the discharged recording material is to be housed in the discharge tray 68 formed in an upper part of the main body housing 21.

The manual supply apparatus (MSI) 71 is installed in a side of the main body housing 21 in this embodiment and a recording material on the manual supply apparatus 71 is sent toward the recording material transport path 25 by the feed roll 72 and the take-away roll 62.

Further, the double-side recording unit 73 is attached to the main body housing 21 and the double-side recording unit 73, when the double side mode in which images are recorded on both sides of the recording material is selected, takes the recording material subjected to recording in one face in the inside by reversely rotating the discharge roll 67 and uses the guide roll 74 in front of the inlet; transports the recording material along with the recording material return transport path 76 by a proper number of transport rolls 77; and supplies the recording material to the registration roll 63 again.

Next, the cleaning apparatus 34 installed in the inside of the tandem type image forming apparatus shown in FIG. 1 will be described in detail.

Figure 2:
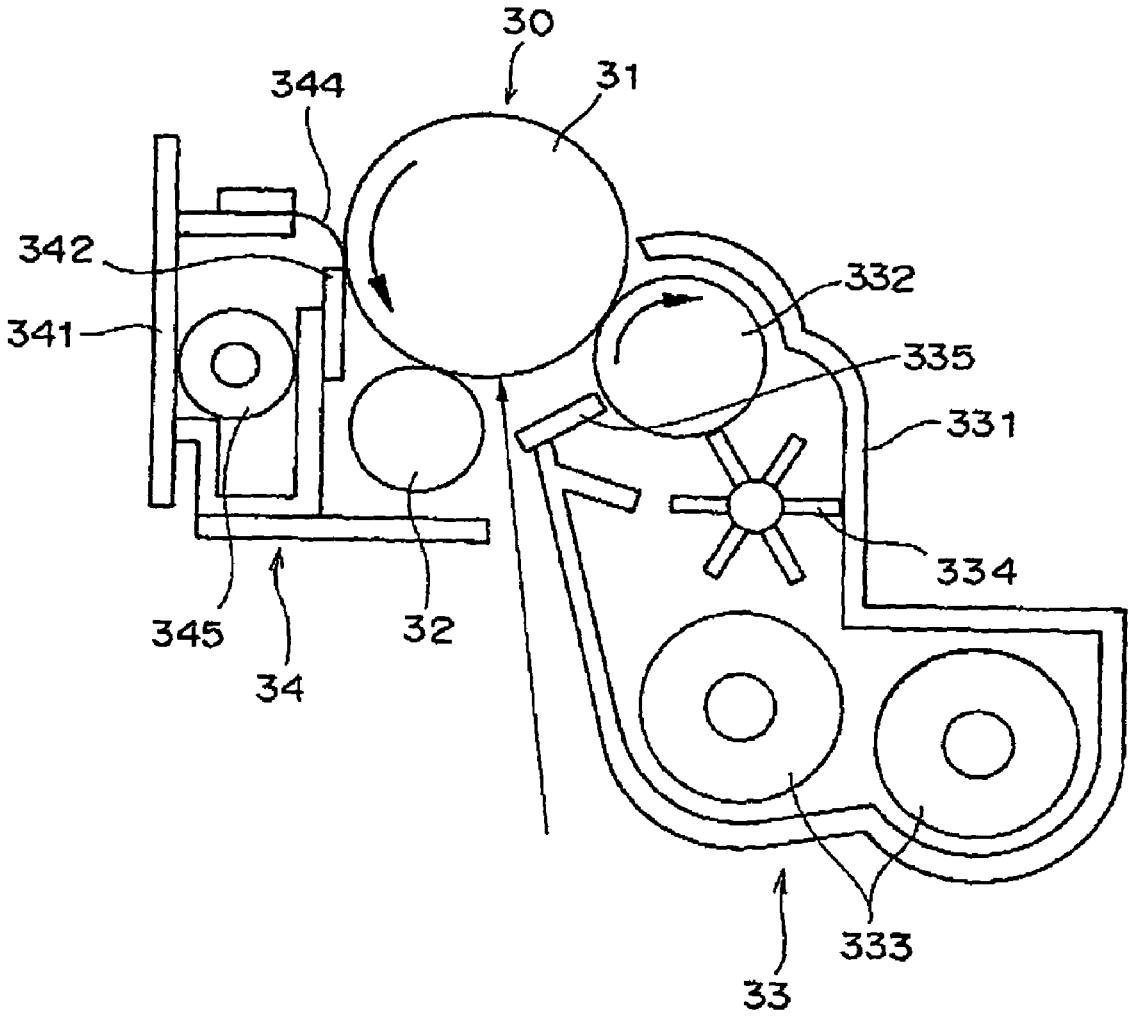
FIG. 2 is a schematic illustration showing one example of a cleaning apparatus of the invention.

FIG. 2 is a schematic drawing showing one example of the cleaning apparatus of the invention and showing the photoreceptor drum 31 in a cartridge form, the charging roll 32 and the developing unit 33 simultaneously with the cleaning apparatus 34 shown in FIG. 1.

In FIG. 2, 32 is a charging roll (the charging apparatus), 331 is a unit case, 332 is a development roll, 333 is a transport auger, 334 is a transport paddle, 335 is a trimming member, 341 is a cleaning case, 342 is a cleaning blade, 344 is a film seal, and 345 is a transport auger.

The cleaning apparatus 34 comprises the cleaning case 341 for housing residual toner therein and having opening on the opposite to the photoreceptor drum 31 and the cleaning blade 342 is attached to the lower rim of the opening of the cleaning case 341 being brought into contact with the photoreceptor drum 31 by a bracket not illustrated in the drawing and on the other hand, the film seal 344 for air-tightly closing the photoreceptor drum 31 is attached to the upper rim of the opening of the cleaning case 341. The reference numeral 345 denotes the transport auger for leading the used toner housed in the cleaning case 341 to a used toner container.

Next, the cleaning blade installed in the cleaning apparatus 34 will be described in detail along with a drawing.

Figure 3:
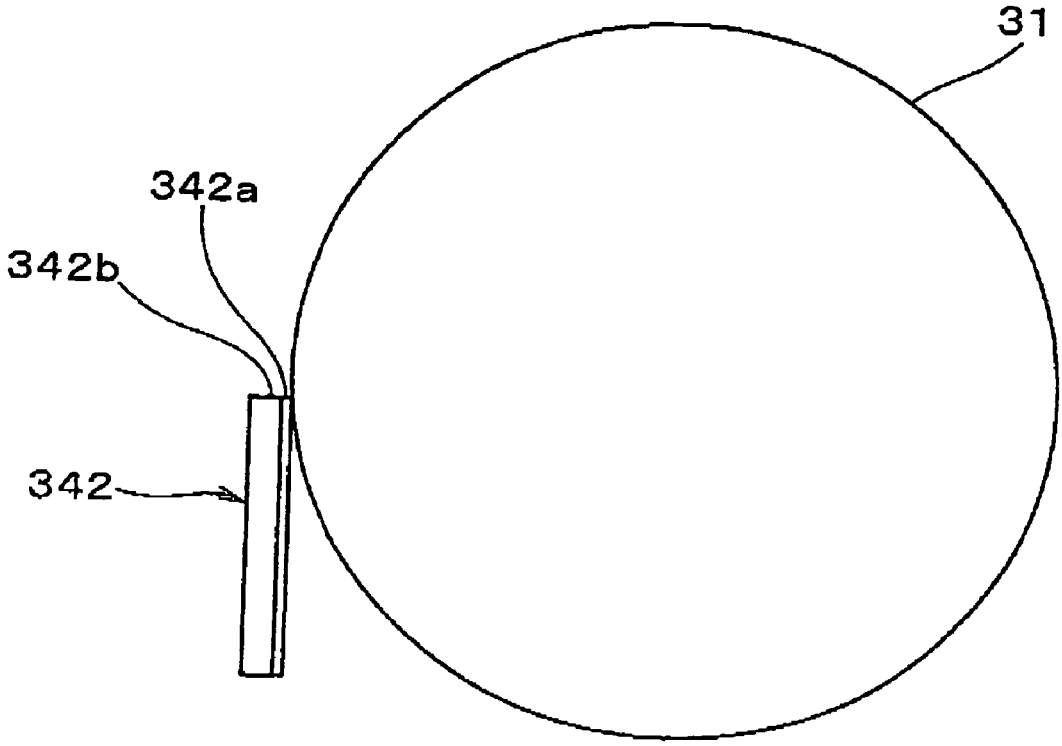
FIG. 3 is a schematic illustration showing one example of a cleaning blade of the invention.

FIG. 3 is a schematic cross-sectional view showing one example of the cleaning blade of the invention and the cleaning blade 342 shown in FIG. 2 is illustrated together with the photoreceptor drum 31 which is brought into contact with the cleaning blade. In FIG. 3, 342*a* is a layer in the cleaning edge side and 342*b* is a layer in the rear face side. The cleaning blade 342 shown in FIG. 3 is composed of two layers; the layer 342*a* in the cleaning edge side and the layer 342*b* in the rear face side; and made of elastic material of polyurethane rubber.

The polyurethane material composing the layer 342*b* in the rear face side is may be an ester type polyurethane and an ether type polyurethane and the ester type polyurethane is preferable.

At the time of producing ester type polyurethane rubber, a polyester polyol and a polyisocyanate may be used.

As the polyisocyanate, 2,6-toluene diisocyanate (TDI), 4,4'-diphenylmethane diisocyanate (MDI), p-phenylene diisocyanate (PPDI), 1,5-naphthalene diisocyanate (NDI), 3,3-dimethyldiphenyl-4,4'-diisocyanate (TODI) can be exemplified. MDI is specially preferable in terms of properties and cost.

At the time of producing urethane rubber using the above-mentioned polyester polyol, the polyester polyol and a short chain polyol as a chain extension agent are mixed and reacted with a polyisocyanate. The reaction may be carried out by a conventional production method of polyurethane, such as a prepolymer method, a one-shot method and the like.

The layer 342*a* in the cleaning edge side can be produced using a soft segment material satisfying the above-mentioned conditions defined by (1) to (4), such as acrylic resins having two or more hydroxyl groups, polybutadiene resins having two or more hydroxyl groups, or epoxy reins having two or more epoxy groups, in addition to the material used for forming the layer 342*b* in the rear face side.

The thickness of the layer 342*a* in the cleaning edge side is controlled to be 0.5 mm and the thickness of the layer 342*b* in the rear face side is controlled to be 1.5 mm. The cleaning blade 342 can be produced by previously producing the layer 342*a* in the cleaning edge side and the layer 342*b* in the rear face side in sheet-like form and sticking the materials for the respective layers with an abrasive, a double-sided tape or the like. Further, in the case of producing it by centrifugal molding, at the time of injecting the raw materials of the respective layers, the materials are successively injected with time difference to form the cleaning blade.

Further, the contact pressure of the cleaning blade 342 to the photoreceptor drum 31 is set to be about 2.0 to 6.0 fg/mm ($=2.0\times10^{-3}\times9.8$ N/mm to $6.0\times10^{-3}\times9.8$ N/mm).

In this embodiment, in all of the cleaning apparatuses 34 of the respective image forming engines 22 (22*a* to 22*d*), the cleaning blade of the invention is used as the cleaning blade 342 and additionally, the cleaning blade 531 employed in the belt cleaning apparatus 53 may be the cleaning blade of the invention.

The developing unit (the developing apparatus) 33 employed in this embodiment of the invention, as shown in. FIG. 2, comprises the unit case 331 storing the developer and having an opening on the opposite to the photoreceptor drum 31. The development roll 332 is installed at the position facing to the opening of the unit case 331 and the transport auger 333 for stirring and transporting the developer is installed in the unit case 331. Further, the transport paddle 334 may be installed between the development roll 332 and the transport auger 333, based on the necessity.

At the time of development, after the developer is supplied to the development roll 332, in the condition that the layer thickness of the developer is controlled by the trimming member 335, the developer is transported to the development region on the opposite to the photoreceptor drum 31.

In this embodiment, as the developing unit 33, a two-component type developer comprising a toner and a carrier is used, however a developing unit for a one-component type developer comprising only a toner may also be used.

In the case of using the two-component developer, following BCO occurrence, the carrier pieces may be buried and fixed in the surface of the image holding member 30. However, even in this case, since the cleaning apparatus 34 is provided with the cleaning blade of the invention, occurrence of cracking can be suppressed for a long period of time and good cleaning capability can be maintained continuously.

The toner as described above may be used as the toner to be used in this embodiment and in terms of the transferring property and image quality, the toner is preferable to have a shape factor SF lower than 140.

Next, the operation of the image forming apparatus of the embodiment will be described. At first, when monotonous toner images corresponding to the respective colors are formed by the respective image forming engines 22 (22*a* to 22*d*), the monotonous toner images with respective colors are successively overlaid and primarily transferred on the surface of the intermediate transfer belt 230 so as to confirm the images with the original manuscript information. Successively, the color toner image transferred on the surface of the intermediate transfer belt 230 is transferred to the surface of a recording material by the secondary transfer apparatus 52 and the recording material to which the color toner image is transferred is subjected to fixing treatment by the fixing apparatus 66 and then discharged to the discharge tray 68.

On the other hand, in the respective image forming engines 22 (22*a* to 22*d*), the residual toner on the photoreceptor drum 31 is cleaned out by the cleaning apparatuses 34 and the residual toner on the intermediate transfer belt 230 is cleaned out by the belt cleaning apparatus 53.

In such image forming process, the residual toner is cleaned out by the cleaning apparatuses 34 (or the belt cleaning apparatus 53).

Further, as shown in FIG. 2, a cleaning blade 342 is not fixed directly to the frame member in the cleaning apparatus 34 but fixed thereto through a spring member.

Figure 4:
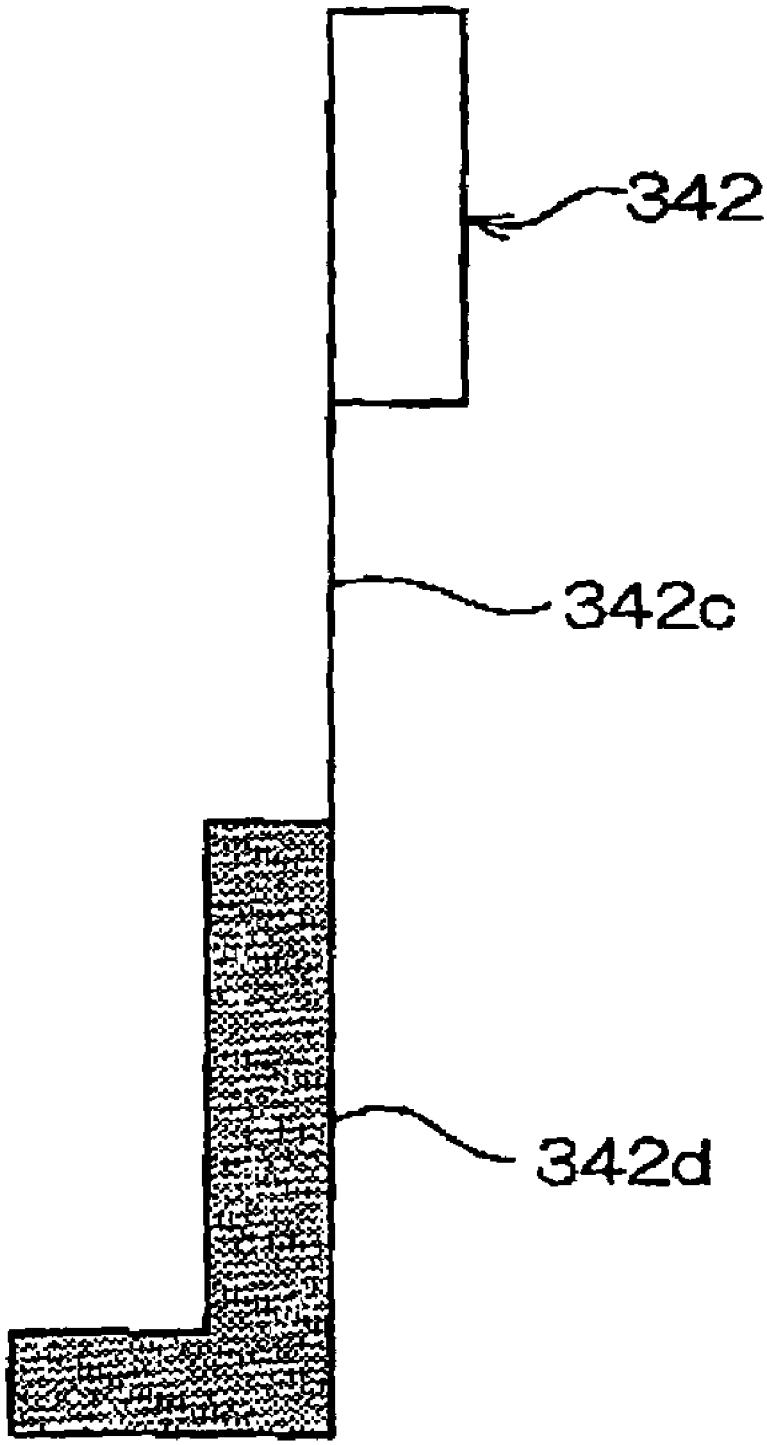
FIG. 4 is a schematic illustration showing an example of a fixing method of the cleaning blade of the invention.

FIG. 4 is a schematic view of an example of a method for fixing the cleaning blade of the present invention. In this figure, a reference numeral 342 denotes a cleaning blade, a reference numeral 342*c* denotes a spring material, and a reference numeral 342*d* denotes a holder. As shown in FIG. 4, one side of the cleaning blade 342 (the side which is not kept in contact with the photoreceptor) is adhesively fixed to a plate-shaped spring material 342*c*, and attached to a holder 342*d* at the opposite side of the side of the spring material 342*c* to which the cleaning blade is fixed. As the spring material 342*c*, a metal material can be used which hardly causes plastic deformation such as an SUS whose young's modulus has a low dependency of temperate.

As shown in FIG. 4, when the cleaning blade is fixed to the frame member of the cleaning apparatus through the spring material or the holder, since the spring material is responsible for the pressure applied from the cleaning blade, as compared to a case in which the cleaning blade is fixed to the frame member of the cleaning apparatus, collapse of the cleaning blade can be suppressed, and dependence on the environmental performance of the pressure when the cleaning blade is made to contact with the photoreceptor can be minimized. Accordingly, the pressure when the cleaning blade is brought into contact with the photoreceptor becomes stable for a long period of time and excellent cleaning performance can be maintained Some embodiments of the invention are outlined below.

According to a first aspect of the invention, a cleaning blade for cleaning a surface of an object to be cleaned, comprising:

a contact portion that contacts the surface of the object for cleaning, the contact portion being made of a material satisfying the following inequalities (1) to (3):

$$3.92 \leqq M \leqq 29.42; \quad (1)$$

$$0 < \alpha \leqq 0.294; \text{ and} \quad (b\ 2)$$

$$S \geqq 250 \quad (3)$$

wherein M denotes 100% modulus (MPa); α denotes the ratio {Δstress/Δstrain degree=(stress at 200% strain degree−stress at 100% stain degree)/(200−100)} (MPa/%) of the stress alteration (Δstress) to the strain alteration (Δstrain) in a range of 100% to 200% stain degree in the stress-strain curve; and S denotes the bttaking elongation (%).

The breaking elongation S is 500 or less.

The glass transition temperature of the contact portion is 10° C. or lower.

The impact resilience of the material of the contact portion is 10% or more under the environmental temperature of 10° C. or higher.

The material of the contact portion is an elastomer material containing a hard segment and a soft segment and the weight ratio of the material composing the bard segment is in a range of 46 to 96% by weight to the total weight of the material composing the hard segment and the material composing the soft segment.

The material composing the hard segment contains a polyurethane resin.

The material composing the soft segment contains a resin having a functional group reactive to an isocyanate group, the resin also having a glass transition temperature of 0° C. or lower, a viscosity in a range of 600 to 35,000 mPa·s at 25° C., and a weight average molecular weight in a range of 700 to 3,000.

The resin contains an acrylic resin having two or more hydroxyl groups or a polybutadiene resin having two or more hydroxyl groups.

The resin contains an epoxy resin having two or more epoxy groups.

The cleaning blade includes two or more layers including a layer that contacts the surface of the object to be cleaned, and wherein the layer that contacts the surface of the object is made of a material satisfying the inequalities (1) to (3).

According to a second aspect of the invention, a cleaning apparatus comprising the cleaning blade described in the first aspect.

The breaking elongation S is 500 or less.

The glass transition temperature of the contact portion of the cleaning blade is 10° C. or lower.

The impact resilience of the material of the contact portion is 10% or more under the environmental temperature of 10° C. or higher.

According to a third aspect of the invention, a process cartridge detachably attached to an image forming apparatus, the process cartridge comprising:

an image holding member; and the cleaning apparatus described in an aspect.

The breaking elongation S is 500 or less.

The glass transition temperature of the contact portion is 10° C. or lower.

The impact resilience of the material of the contact portion is 10% or more under the environmental temperature of 10° C. or higher.

The surface of the image holding member is covered with a layer containing a fluoro resin.

The surface of the image holding member is covered with a layer having charge transport capability and a layer containing a resin having a crosslinked structure.

The resin having a crosslinked structure is selected from the group consisting of phenol resins, urethane resins, and siloxane resins.

According to a fourth aspect of the invention, an image forming apparatus comprising:

at least one object to be cleaned; and at least one cleaning apparatus having the cleaning blade described in the first aspect.

The breaking elongation S is 500 or less.

The glass transition temperature of the contact portion is 10° C. or lower.

The impact resilience of the material of the contact portion is 10% or more under the environmental temperature of 10° C. or higher.

The material of the contact portion is an elastomer material containing a hard segment and a soft segment and the weight ratio of the material composing the hard segment is in a range of 46 to 96% by weight to the total weight of the rnatei composing the hard segment and the material composing the soft segment.

The material composing the hard segment contains a polyurethane resin.

The material composing the soft segment contains a resin having a functional group reactive to an isocyanate group, the resin also having a glass transition temperature of 0° C. or lower, a viscosity in a range of 600 to 35,000 mPa·s at 25° C., and a weight average molecular weight in a range of 700 to 3,000.

The resin contains an acrylic resin having two or more hydroxyl groups or a polybutadiene resin having two or more hydroxyl groups.

The resin contains an epoxy resin having two or more epoxy groups.

The cleaning blade includes two or more layers including a layer that contacts the surface of the object to be cleaned, and wherein the layer that contacts the surface of the object is made of a material satisfying the inequalities (1) to (3).

EXAMPLES

Hereinafter, the invention will be described along with preferred embodiments, however it is not intended that the invention be limited to the illustrated embodiments. Modifications and substitutions to specific process conditions and structures can be made without departing from the spirit and scope of the invention.

—Production of Cleaning Blade—

<Cleaning Blade A1>

At first, hard segment materials containing, as polyol components, polycaprolactone polyol (Placcel 205, an average molecular weight 529, hydroxyl value 212 mgKOH/g, manufactured by Daicel Chemical Industries, Ltd.) and polycaprolactone polyol (Placcel 240, an average molecular weight 4,155, hydroxyl value 27 mgKOH/g, manufactured by Daicel Chemical Industries, Ltd.) and a soft segment material comprising an acrylic resin containing two or more hydroxyl group (Actflow UMB-2005B, manufactured by Soken Chemical Engineering Co., Ltd.) are mixed at 8:2 (by weight).

Next the mixture 100 part by weight of the hard segment material and the soft segment material is mixed with, as an isocyanate compound, 4,4'-diphenylmethane diisocyanate (Millionate MT, hereinafter referred to as MDI, manufactured by Nippon Polyurethane Industry Co., Ltd.) 6.26 part by weight and reaction is carried out at 70° C. for 3 hours in nitrogen atmosphere.

The isocyanate compound used in this reaction is selected so as to adjust the ratio (isocyanate group/hydroxyl group) of the isocyanate groups to the hydroxyl groups contains in the reaction system to be 0.5.

Successively, the above-mentioned isocyanate compound 34.3 part by weight is further added and reaction is carried out at 70° C. for 3 hours in nitrogen atmosphere to obtain a prepolymer.

The total amount of the isocyanate compound used at the time of using the prepolymer is 40.56 part by weight.

Next, the prepolymer is heated to 100° C. and defoamed for 1 hour in reduced pressure and then, the prepolymer 100 part by weight is mixed with a mixture 7.14 part by weight of 1,4-butanediol and trimhethylolpropane (weight ratio=60/40) and sufficiently mixed for 3 hours without entraining foams therein and cured by a centrifugal molding apparatus whose die is adjusted to be at 140° C. to obtain a flat plate. The flat plate is cooled after crosslinking at 110° C. for 24 hours and cut into a predetermined size to obtain a cleaning blade A1 with a thickness of 2 mm.

<Cleaning Blade A2>

As the hard segment materials, the same hard segment materials as those used in the production of the cleaning blade A1 are used and a polybutadiene resin (R-45HT, manufactured by Idemitsu Kosan Co., Ltd.) having two or more hydroxyl groups is used as a soft segment material at the ratio of the hard segment materials and the soft segment material 8:2.

A cleaning blade A2 is produced in the same manner as Example 1, except that the mixture is used.

<Cleaning Blade A3>

As the hard segment materials, the same hard segment materials as those used in the production of the cleaning blade A1 are used and an epoxy resin (EPICLON EXA-4850-150, manufactured by Dainippon Ink and Chemicals, Inc.) having two or more epoxy groups is used as a soft segment material at the ratio of the bard segment materials and the soft segment material 8:2.

A cleaning blade A3 is produced in the same manner as Example 1, except that the mixture is used.

<Cleaning Blade A4>

The cleaning blade A4 is manufactured in the same manner as in the cleaning blade A1 except that a mixture ratio of the hard segment material to the soft segment material is changed to 90:10.

<Cleaning Blade A5>

The cleaning blade A5 is manufactured in the same manner as in the cleaning blade A1 except that a mixture ratio of the hard segment material to the soft segment material is changed to 96:4.

<Cleaning Blade A6>

The cleaning blade A6 is manufactured in the same manner as in the cleaning blade A1 except that a mixture ratio of the hard segment material to the soft segment material is changed to 98:2.

<Cleaning Blade B1>

A cleaning blade B1 is produced in the same manner as Example 1, except that only a polyol component is used in place of the mixture of the hard segment materials and the soft segment material and Nippollan 4038 (manufactured by Nippon Polyurethane Industry Co., Ltd.) 6.8 part by weight as an isocyanate compound is used in combination with Coronate 4086 (manufactured by Nippon Polyurethane Industry Co., Ltd.) 100 parts as the polyol component.

<Cleaning Blade B2>

A cleaning blade B2 is produced in the same manner as Example 1, except that only a polyol component is used in place of the mixture of the hard segment materials and the soft segment material and Nippollan 4379 (manufactured by Nippon Polyurethane Industry Co., Ltd.) 75 part by weight as an isocyanate compound is used in combination with Coronate 4370 (manufactured by Nippon Polyurethane Industry Co., Ltd.) 100 parts as the polyol component.

<Cleaning Blade B3>

A cleaning blade B3 is produced in the same manner as Example 1, except that only polyol component is used in place of the mixture of the hard segment materials and the soft segment material and Nippollan 4379 (manufactured by Nippon Polyurethane Industry Co., Ltd.) 85 part by weight as an isocyanate compound is used in combination with Coronate 4370 (manufactured by Nippon Polyurethane Industry Co., Ltd.) 100 parts as the polyol component.

—Production of Photoreceptor—

<Photoreceptor A>

A coating solution for underlayer formation is obtained by an organic zirconium compound (acetylacetone zirconium butyrate) 30 part by weight and an organic silane compound (γ-aminopropyltrimethoxysilane) 3 part by weight are added to and mixed with n-butyl alcohol 170 part by weight in which a polyvinyl butyral resin (S-Lec BM-S, manufactured by Sekisui Chem. Co., Ltd.) 4 part by weight is dissolved.

The coating solution is applied to an aluminum support with an outer diameter 40 mm surface roughened by horning treatment by dipping and dried at a room temperature for 5 minutes and then the resulting support is heated to 50° C. for 10 minutes and humidification curing promotion treatment is carried out for 20 minutes after the support is put in a chamber at 50° C. and 85% RH (dew point 47° C.). After that, the support is put in a hot air drier to carry out drying at 170° C. for 10 minutes to form an underlayer formation.

As a charge generation material, a gallium chloride-phthalocyanine complex is used and a mixture containing the complex 15 part, vinyl chloride-vinyl acetate copolymer resin (VMCH, manufactured by Nippon Unicar Co., Ltd.) 10 part by weight, and n-butyl alcohol 300 part by weight is dispersed for 4 hours by a sand mill to obtain a dispersion. The dispersion is applied to the underlayer by dipping and dried to form a charge generation layer with a film thickness of 0.2 μm.

Next, a coating solution obtained by sufficiently dissolving and mixing N,N'-bis(3-methylphenyl)N,N'-diphenylbenzidine 40 part by weight and bisphenol Z-polycarbonate resin (viscosity average molecular weight 40,000) 60 part by weight in and with tetrahydrofuran 235 part by weight and monochlorobenzene 100 part by weight is applied by dipping to the aluminum support coated with the charge generation layer and dried at 120° C. for 40 minutes to form a charge transport layer with a film thickness of 24 μm and obtain a photoreceptor A.

<Photoreceptor B>

N,N'-bis(3-methylphenyl)-N,N'-diphenylbenzidine 40 part by weight and bisphenol Z-polycarbonate resin (viscosity average molecular weight 40,000) 60 part by weight are sufficiently dissolved in and mixed with tetrahydrofuran 280 part by weight and toluene 120 part by weight and further tetrafluoroethylene resin particles 10 part by weight is added and further mixed.

At that time, the room temperature is set at 25° C. and the liquid temperature at the time of mixing is kept at 25° C. After that, the mixture is dispersed by sand grinder using glass beads to produce a tetrafluoroethylene resin particle dispersion. At that time, water at 24° C. is passed to the vessel of the sand grinder to keep the dispersion temperature at 50° C.

The coating solution obtained in such a manner is applied by dipping to the surface of a cylindrical substrate coated with the charge generation layer in the same manner as described above and dried at 120° C. for 40 minutes to form a charge transport layer with a film thickness of 25 μm and obtain a photoreceptor B.

<Photoreceptor C>

The following compound 1 shown below 2 part by weight, Resitop PL 4852 (manufactured by Gun-ei Chemical Industry Co., Ltd.) 2 part are dissolved in isopropyl alcohol 10 part by weight to obtain a coating solution for protection layer formation. The coating solution for the protection layer formation is applied by dipping to the charge transport layer of a photoreceptor produced in the same conditions as those of the photoreceptor A production, except that the film thickness of the charge transport layer is changed to be 22 μm and then dried at a room temperature for 30 minutes and then further dried at 140° C. for 60 minutes to form a protection layer with a film thickness of 4 μm and obtain a photoreceptor C.

Compound 1

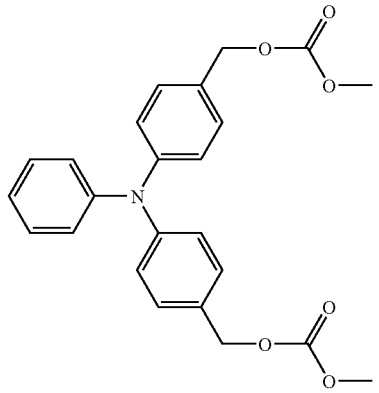

The cleaning blades A1 to A3 and B1 to B3 and the photoreceptors A to C described above are combined as shown in Table 3 and installed in an image forming apparatus (DocuCentre Color 400CP, manufactured by Fuji Xerox Co., Ltd.) and subjected to various evaluation tests and the results are shown in Table 3 in combination with the compositions and physical properties of the cleaning blades used for the test.

Figure 5:
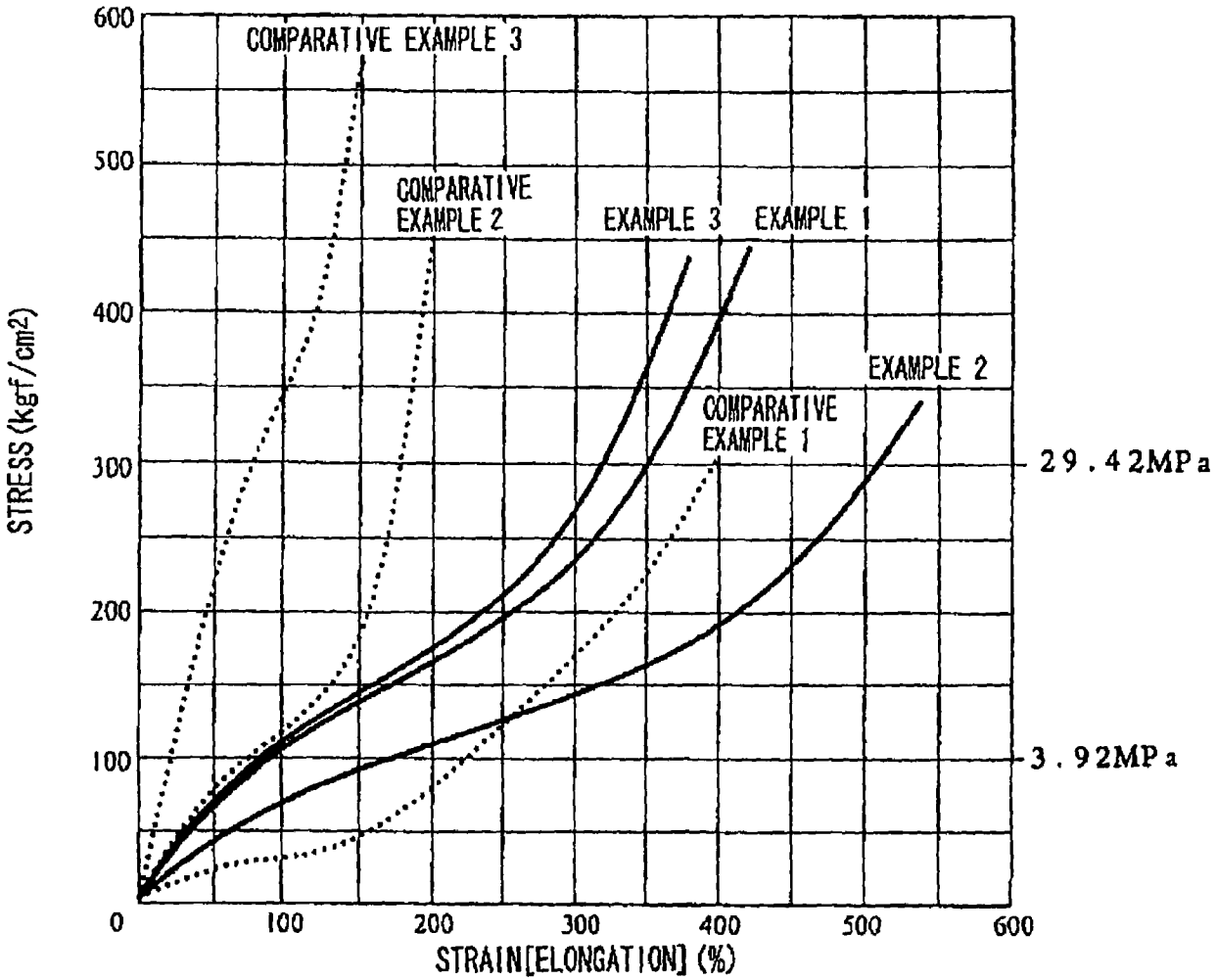
FIG. 5 is a graph showing the correlation between the strain degree and stress of the cleaning blades of Examples 1 to 3 and Comparative Examples 1 to 3.

The graph showing the correlation of the strain degree and the stress of the cleaning blades used in Examples 1 to 3 and Comparative Examples 1 to 3 is shown in FIG. 5.

TABLE 3

| | | Example 1 | Example 2 | Example 3 | Example 4 | Example 5 | Comparative Example 1 | Comparative Example 2 | Comparative Example 3 |
|---|---|---|---|---|---|---|---|---|---|
| Cleaning blade | | A1 | A2 | A3 | A1 | A2 | B1 | B2 | B3 |
| Composition | Hard segment material (H) | Polycaprolactone polyol | | | | | Polyol | Polyol | Polyol |
| | Soft segment material (S) | Acrylic resin | Polybutadiene resin | Epoxy resin | Acrylic resin | Polybutadiene resin | component (Coronate 4086) | component (Coronate 4370) | component (Coronate 4370) |
| | Hard segment material ratio [H/(H + S)] (% by weight) | 80 | 80 | 80 | 80 | 80 | — | — | — |
| Physical properties | 100% modulus (MPa) | 10.8 | 7.4 | 11.3 | 10.8 | 10.8 | 3.4 | 11.8 | 33.3 |
| | α [Δstress/Δstrain degree] (MPa/%) | 0.059 | 0.039 | 0.059 | 0.059 | 0.059 | 0.044 | 0.324 | — |
| | Breaking elongation (%) | 420 | 535 | 380 | 420 | 420 | 400 | 200 | 150 |
| | Impact resilience (%) | 20 | 35 | 17 | 20 | 20 | — | — | — |
| | Grass Transition Point (° C.) | −10 | −8 | −5 | −10 | −10 | — | — | — |
| Photoreceptor | | A | A | A | B | C | A | A | A |
| Evaluation results | Edge wear | G2 | G2 | G2 | G1 | G2 | G4 | G2 | G1 |
| | Edge cracking | G2 | G2 | G2 | G1 | G2 | G2 | G4 | G5 |
| | Scratches of photoreceptor | G1 | G1 | G1 | G1 | G1 | G1 | G1 | G2 |
| | Wear rate of photoreceptor (nm/k-cycle) | 40 | 40 | 40 | 30 | 10 | 40 | 40 | 40 |

The evaluation methods and evaluation standards for the edge wear edge cracking, photoreceptor scratching, and photoreceptor wear rate are as follows.

—Edge Wear—

At the time of evaluating the edge wear, image forming is carried out using A4-size paper sheets (210×297 mm, P paper, manufactured by Fuji Xerox Co., Ltd.) until the integrated rotation times of the photoreceptor reaches 100 k-cycles at high temperature and high humidity environments (28° C., 85% RH) and after that, the wear at the edge tip end of each cleaning blade and the cleaning failure are collectively evaluated.

At the time of the test, to evaluate in severe condition that the lubricating effect in the contact part between the photoreceptor and the cleaning blade, the image density of the image to be formed is set to be 1%.

Successively, the wear depth of the edge tip end after he test is observed from the cross-section face side of each cleaning blade by a laser microscope VK-8510 manufactured by Keyence Corp and the maximum depth in the edge cracked part in the surface side of each photoreceptor is measured.

On completion of the above-mentioned test, the cleaning failure evaluation is carried out by feeding a A3 size paper sheet on which an un-transferred solid image (solid image size: 400 mm×290 mm) is formed between the photoreceptor and each cleaning blade at a normal process speed and immediately after the last terminal end part of the unfixed image in the transport direction is passed the contact part between the photoreceptor and the cleaning blade, the apparatus is stopped and the passing through of the toner is observed with eye. In the case where significant passing through is observed, it is regarded as cleaning failure.

In the case where the portion clogging and shutting a toner is cracked owing to wear and cracking of the edge tip end, the cleaning failure in the above-mentioned test tends to take place more easily as the edge wear depth and the cracking depth are deeper, so that the test is useful for the qualitative evaluation of the wear and cracking of the edge tip end. The evaluation standards of the edge wear are shown in Table 4. The allowable range is G0 to G2.

TABLE 4

| Edge wear evaluation grade | Edge wear depth | Cleaning failure |
|---|---|---|
| G0 | 3 μm or less and none after wear | None |
| G1 | 3 μm or less | None |
| G2 | More than 3 μm and 5 μm or less | None |
| G3 | More than 3 μm and 5 μm or less | Occurring |
| G4 | More than 5 μm and 10 μm or less | Occurring |
| G5 | More than 10 μm | Occurring |

—Edge Cracking—

The edge cracking is caused by repeated pass of foreign substances adhered to the surface of the photoreceptor in the contact part between the photoreceptor and the cleaning blade. Therefore, in low temperature and low humidity (10° C. and 15% RH) environments in which the elasticity of each cleaning blade is decreased and the stress at the time when the cleaning blade comes into collision against the foreign substances tends to be significant, a toner band with 5 mm width is formed every 5 k-cycles and the depth and the number of the cracks of the edge after 100 k-cycle runs of a photoreceptor drum are measured.

The depth of the cracks of the edge is measured by measuring the depth of the edge cracked part in the surface side of the photoreceptor at the time when the cross-sectional side of the cleaning blade is observed by a laser microscope VK-8510 manufactured by Keyence Corp. In this case, the number of the cracks with a width of 5 μm or wider is evaluated. The evaluation standards of the cracks in the edge are shown in Table 5. The allowable range is G0 to G2.

TABLE 5

| Edge cracking evaluation grade | Number of cracks of 5 μm or wider |
|---|---|
| G0 | 0 |
| G1 | 1 to 5 |
| G2 | 6 to 10 |
| G3 | 11 to 20 |
| G4 | 21 to 30 |
| G5 | 31 or more |

—Scratch of Photoreceptor—

The scratches of each photoreceptor are evaluated by existence of white stripes on a printing owing to the scratches of the photoreceptor by a half-tone image printed after 100,000 cycle runs. The evaluation standards of the scratches of the photoreceptor are as follows. The allowable range is G1.

G1: No white stripe is formed on the printing.

G2: White stripes are formed on the printing.

—Wear Rate of Photoreceptor—

The wear rate of the photoreceptor is calculated per 1,000 cycle runs of the photoreceptor by measuring the film thickness of the photoreceptor before and after the test by an eddy current type film thickness meter and calculating the difference.

[Evaluation of Local Edge Deformation]

In addition to the above described evaluation, local edge deformations of the cleaning blades A1, A4, A5, and A6 are evaluated.

Evaluation is made by attaching the cleaning blades A1, A4, A5, and A6 and a photoreceptor A to an image forming apparatus (product name-Docu Center Color 400CP manufactured by Fuji Xerox Co., Ltd.) so as to provide such combinations as shown in Table 6. The results of evaluation are shown in Table 6, together with compositions and material characteristics of the cleaning blades used for the test.

TABLE 6

| | | Example 1 | Example 6 | Example 7 | Example 8 |
|---|---|---|---|---|---|
| Cleaning blade | | A1 | A4 | A5 | A6 |
| Composition | Hard segment material (H) | Polycaprolactone polyol | | | |
| | Soft segment material (S) | Acrylic resin | Acrylic resin | Acrylic resin | Acrylic resin |
| | Hard segment material ratio [H/(H + S)] (% by weight) | 80 | 90 | 96 | 98 |

TABLE 6-continued

| | | Example 1 | Example 6 | Example 7 | Example 8 |
|---|---|---|---|---|---|
| Physical properties | 100% modulus (MPa) | 10.8 | 14 | 16 | 17 |
| | α [Δstress/Δstrain degree] (MPa/%) | 0.059 | 0.082 | 0.093 | 0.105 |
| | Breaking elongation (%) | 420 | 400 | 390 | 380 |
| | Impact resilience (%) | 20 | 10 | 8 | 5 |
| Photoreceptor | | A | A | A | B |
| Evaluation results | Local edge deformation | G0 | G0 | G1 | G1 |

Further, evaluation methods and evaluation standards of local edge deformations in table 6 arc as described below:

—Evaluation Method of Local Edge Deformation—

A4 size paper (210×297 mm, P-type paper manufactured by Fuji Xerox Co., Ltd.) is used to form an image thereon, under the environment whose temperature is low and whose moisture is low (10° C. and 15 RH %) by which the rubber elasticity of the cleaning blade is decreased, and the stick and strip behaviors become dull, until the number of cycles of the photoreceptor becomes 100K. Thereafter, deformation of the edge tip end of the cleaning blade and cleaning failure are evaluated and judged at the same time.

During the test, in order to evaluate local edge deformation under a severe condition in which lubricant effects are deliberately reduced at the portion of the cleaning blade at which the photoreceptor and the cleaning blade arc brought into contact with each other, density of the image to be formed is 1%.

Subsequently, when deformation at the edge tip end of the cleaning blade for which the test has been completed is observed by a laser microscope VK-8510, the width of a portion having local deformation in the widthwise direction of the edge tip end of the cleaning blade is measured.

Further, after the above-described test is completed, A3-size paper having a solid image untransferred thereon (solid image size: 400 mm×290 mm) was used to evaluate cleaning failure. First, A3-size paper is fed into the photoreceptor and the cleaning blade at a normal processing speed. Immediately after the transport direction trailing edge of an unfixed image finally passed through the portion at which the photoreceptor and the cleaning blade are brought into contact with each other, the test machine is stopped. Then, it is visually observed if there exists the toner that fails to slip off from the cleaning blade. If a remarkable amount of the toner that failed to slip off from the cleaning blade corresponding to a locally deformed portion is found, it is considered as cleaning failure.

Evaluation standards shown in table 6 are as described below:

G0: Local edge deformation is not found and no cleaning failure due to the local edge deformation occurrs.

G1: Some local edge deformation is found: however, no cleaning failure due to the local edge deformation occurrs.

G2: Local edge deformation is found, and cleaning failure due to the local edge deformation occurrs.

According to an aspect of the invention, a cleaning blade which is excellent both in wear resistance and cracking resistance and which can maintain excellent cleaning performance for a long period of time, and a cleaning apparatus, a process cartridge and an image forming apparatus using the same are provided.

What is claimed is:

1. A cleaning blade for cleaning a surface of an object to be cleaned, comprising:

a contact portion that contacts the surface of the object for cleaning, the contact portion being made of a material satisfying the following inequalities (1) to (3), the material of the contact portion being an elastomer material containing a hard segment and a soft segment, and the hard segment containing a polyurethane resin:

$$3.92 \leqq M \leqq 29.42; \quad (1)$$

$$0 < \alpha \leqq 0.294; \text{ and} \quad (2)$$

$$S \geqq 250 \quad (3)$$

wherein M denotes 100% modulus (MPa); α denotes the ratio {Δstress/Δstrain degree=(stress at 200% strain degree−stress at 100% strain degree)/(200−100)} (MPa/%) of the stress alteration (Δstress) to the strain alteration (Δstrain) in a range of 100% to 200% strain degree in the stress-strain curve; S denotes the breaking elongation (%); and a glass transition temperature of the contact portion is 10° C. or lower.

2. The cleaning blade according to claim 1, wherein the breaking elongation S is 500 or less.

3. The cleaning blade according to claim 1, wherein the impact resilience of the material of the contact portion is 10% or more under the environmental temperature of 10° C. or higher.

4. The cleaning blade according to claim 1, wherein the weight ratio of the material composing the hard segment is in a range of 46 to 96% by weight to the total weight of the material composing the hard segment and the material composing the soft segment.

5. The cleaning blade according to claim 4, wherein the material composing the soft segment contains a resin having a functional group reactive to an isocyanate group, the resin also having a glass transition temperature of 0° C. or lower, a viscosity in a range of 600 to 35,000 mPa·s at 25° C., and a weight average molecular weight in a range of 700 to 3,000.

6. The cleaning blade according to claim 5, wherein the resin contains an acrylic resin having two or more hydroxyl groups or a polybutadiene resin having two or more hydroxyl groups.

7. The cleaning blade according to claim 5, wherein the resin contains an epoxy resin having two or more epoxy groups.

8. The cleaning blade according to claim 1, wherein the cleaning blade includes two or more layers including a layer that contacts the surface of the object to be cleaned, and wherein the layer that contacts the surface of the object is made of a material satisfying the inequalities (1) to (3).

9. A cleaning apparatus comprising the cleaning blade according to claim 1.

10. The cleaning apparatus according to claim 9, wherein the breaking elongation S is 500 or less.

11. The cleaning apparatus according to claim 9, wherein the impact resilience of the material of the contact portion is 10% or more under the environmental temperature of 10° C. or higher.

12. A process cartridge detachably attached to an image forming apparatus, the process cartridge comprising:

an image holding member; and the cleaning apparatus according to claim 9.

13. The process cartridge according to claim 12, wherein the breaking elongation S is 500 or less.

14. The process cartridge according to claim 12, wherein the impact resilience of the material of the contact portion is 10% or more under the environmental temperature of 10° C. or higher.

15. The process cartridge according to claim 12, wherein the surface of the image holding member is covered with a layer containing a fluoro resin.

16. The process cartridge according to claim 12, wherein the surface of the image holding member is covered with a layer having charge transport capability and a layer containing a resin having a crosslinked structure.

17. The process cartridge according to claim 16, wherein the resin having a crosslinked structure is selected from the group consisting of phenol resins, urethane resins, and siloxane resins.

18. An image forming apparatus comprising:

at least one object to be cleaned; and at least one cleaning apparatus having the cleaning blade according to claim 1.

19. The image forming apparatus according to claim 18, wherein the breaking elongation S is 500 or less.

20. The image forming apparatus according to claim 18, wherein the impact resilience of the material of the contact portion is 10% or more under the environmental temperature of 10° C. or higher.

21. The image forming apparatus according to claim 18, wherein the weight ratio of the material composing the hard segment is in a range of 46 to 96% by weight to the total weight of the material composing the hard segment and the material composing the soft segment.

22. The image forming apparatus according to claim 21, wherein the material composing the soft segment contains a resin having a functional group reactive to an isocyanate group, the resin also having a glass transition temperature of 0° C. or lower, a viscosity in a range of 600 to 35,000 mPa·s at 25° C., and a weight average molecular weight in a range of 700 to 3,000.

23. The image forming apparatus according to claim 22, wherein the resin contains an acrylic resin having two or more hydroxyl groups or a polybutadiene resin having two or more hydroxyl groups.

24. The image forming apparatus according to claim 22, wherein the resin contains an epoxy resin having two or more epoxy groups.

25. The image forming apparatus according to claim 18, wherein the cleaning blade includes two or more layers including a layer that contacts the surface of the object to be cleaned, and wherein the layer that contacts the surface of the object is made of a material satisfying the inequalities (1) to (3).

26. A cleaning blade for cleaning the surface of an object to be cleaned, comprising:

a contact portion that contacts the surface of the object for cleaning, the contact portion being made of a material satisfying the following inequalities (1) to (3), the material of the contact portion being an elastomer material containing a hard segment and a soft segment, the hard segment containing a polyurethane resin, and the soft segment having a viscosity in a range of 600 to 35,000 mPa·s at 25° C.:

$$3.92 \leqq M \leqq 29.42; \quad (1)$$

$$0 < \alpha \leqq 0.294; \text{ and} \quad (2)$$

$$S \geqq 250 \quad (3)$$

wherein M denotes 100% modulus (MPa); $\alpha$ denotes the ratio {Δstress/Δstrain degree=(stress at 200% strain degree−stress at 100% strain degree)/(200−100)} (MPa/%) of the stress alteration (Δstress) to the strain alteration (Δstrain) in a range of 100% to 200% strain degree in the stress-strain curve; and S denotes the breaking elongation (%).

* * * * *